US005641156A

United States Patent [19]

Nukada et al.

[11] Patent Number: 5,641,156

[45] Date of Patent: Jun. 24, 1997

[54] APPARATUS FOR INSPECTING SHEET MATERIALS AND CONVEYING DEVICE USED THEREFOR

[75] Inventors: Hideki Nukada, Yokohama; Takahiro Suzuki, Suginami-Ku, both of Japan

[73] Assignee: Kabushiki Kaisha Toshiba, Tokyo, Japan

[21] Appl. No.: 309,208

[22] Filed: Sep. 20, 1994

[30] Foreign Application Priority Data

Sep. 20, 1993 [JP] Japan ..... 5-232642

[51] Int. Cl.[6] ..... B65H 43/00

[52] U.S. Cl. ..... 271/176; 271/178; 271/202; 271/272; 271/315

[58] Field of Search ..... 271/176, 178, 271/202, 315, 187, 272, 273, 274

[56] References Cited

U.S. PATENT DOCUMENTS

| | | | |
|---|---|---|---|
| 4,120,491 | 10/1978 | Lang | 271/178 X |
| 5,054,767 | 10/1991 | Gammerler | 271/272 |

FOREIGN PATENT DOCUMENTS

| | | | |
|---|---|---|---|
| 0119814 | 9/1984 | European Pat. Off. . | |
| 0391550 | 10/1990 | European Pat. Off. . | |
| 62-21663 | 1/1987 | Japan | 271/178 |
| 62-31657 | 2/1987 | Japan . | |
| 62-218355 | 9/1987 | Japan | 271/176 |
| 3-162344 | 7/1991 | Japan | 271/272 |
| 2168687 | 6/1986 | United Kingdom . | |
| 8300136 | 1/1983 | WIPO . | |

*Primary Examiner*—David H. Bollinger
*Attorney, Agent, or Firm*—Loeb & Loeb LLP

[57] ABSTRACT

The sheet material inspection apparatus has a pitch detection section for detecting pitches between sheet materials on a conveying path and a control section which effects so that the sheet material is inserted from a predetermined position of a groove of a rotary body (impeller) by adjusting rotating speed of the rotary body or by using auxiliary conveying path even if a pitch deviation is produced. The sheet material conveying device for conveying sheet materials has a conveying unit which includes pairs of rollers disposed away a predetermined distance from each other, a belt stretched between the pairs of rollers and wound on the rollers through only a predetermined angle; and a guide member disposed between the pairs of rollers so that its upper surface is located more downward by a predetermined spacing than a conveying surface of the belt. Sheet materials are supported between the belt and the guide member and conveyed by driving the belt, which enables high-speed, and less damage, in conveying.

18 Claims, 20 Drawing Sheets

APPARATUS FOR INSPECTING SHEET MATERIALS AND CONVEYING DEVICE USED THEREFOR

BACKGROUND OF THE INVENTION

The present invention relates to an inspection apparatus for detecting whether collected sheet materials are normal or damaged and true or false and for re-accumulating disposable sheet materials and reusable sheet materials and to also a sheet material conveying device suited to this sheet material inspection apparatus.

To start with, a conventional sheet material inspection apparatus will be explained. The sheet material inspection apparatus is an apparatus which consecutively takes out collected sheet materials accumulated and fed in at a minute pitch by a take-out unit and thereafter checks whether the sheet materials are normal or damaged and true or false while conveying them on a belt at a high speed. The sheet material inspection apparatus then determines whether the individual sheet materials are to be disposed of or are reusable, thereafter distributes the sheet materials to branched conveying paths and re-accumulates the disposable sheet materials and the reusable sheet materials, separately.

The sheet materials accumulated as the disposable sheet materials by this apparatus are thereafter shredder-processed. A processing speed of the sheet materials in this inspection apparatus is on the order of 20–30 sheet materials/see, and a conveying velocity is always kept constant at 8 m/s.

FIG. 1 illustrates a construction of a sheet material conveying device employed in the conventional sheet material inspection apparatus. The transfer of the sheet materials involves independent driving sources and is conducted in such a way that the sheet material is grasped from at two portions in the crosswise direction by flat belts 61, 62 whose conveying surfaces are closely fitted to each other. These belts are driven by motors connected to drive rollers. Driving the belts at a high speed normally entails using motors each having a capacity on the order of several hundreds Watt.

As illustrated in FIG. 1, the rollers are disposed alternately on both sides of the conveying path to ensure the close fit between the belts. In the case of such a construction, the above and below belts have a trace of speed-difference, and, hence, a frictional force needs to be applied on both of the belts. For this purpose, the resistance of the conveying system is large, and a large force is required for driving the belts. Further, the belts run with a trace of oscillations in the crosswise direction, but, because of the surfaces being in contact with each other, the belts experience influences of the oscillations on each other. There exists a possibility in which this may cause the belts to come off the rollers. Moreover, the belts always press the upper and lower surfaces of the sheet material, and, consequently, there arises a problem in which the sheet material surface is concealed; and locations for detection are limited.

FIG. 2 depicts a conveying mechanism adopted in the case of conveying sheet materials at a low velocity. The sheet material is grasped between drive rollers 71 and rollers 72, and an up-and-down guide 73 is disposed between the rollers. Down-sizing and a reduction in weight in terms of the mechanism are attainable with this system. However, a leading edge of the sheet material is completely free between the guides and therefore collides with the rollers, easily resulting in damage. A defect is that this system is not suitable for conveying the sheet materials at a high velocity. Furthermore, the following problem also arises. A dispersion in the driving force between the respective rollers is produced by extrinsic factors such as abrasions, contaminations, and the like, on the roller surfaces. This dispersion in the driving force in turn causes a slippage, resulting in a difference in the conveying velocity of the sheet material between the respective rollers. As a result, a jam can easily occur.

The take-out unit for feeding out the sheet materials to the conveying path is constructed of a holed rotor for performing intermittent rotations and a static chamber connected to a vacuum pump. Every time the rotor stops, the take-out unit absorbs the sheet materials one by one from a stack of sheet materials accumulated and pulls it off the stack of sheet materials. The take-out unit thereafter puts the sheet material into the conveying system at a predetermined sheet material pitch (interval between the leading or trailing edges of the sheet materials fed adjacent to each other). A slight pitch error produced on the occasion of this take-out operation, means that the sheet materials having a minute pitch error are consecutively fed in the conveying system.

FIG. 3 schematically illustrates a structure of a sheet material accumulating unit in the prior art sheet material inspection apparatus. This sheet material accumulating unit is constructed mainly of an accumulation impeller 74. The accumulation impeller 74 is a rotary body having spiral blades at equal intervals with spiral grooves therebetween about the center thereof. The impeller 74 is belt-driven by a stepping motor 78. The sheet material fed in is stopped upon an insertion into the groove, thereafter scraped out of the groove and thus re-accumulated. The sheet materials are then transferred to the next processing.

Herein, for preventing a damage of the sheet material due to a jam and a collision with a blade, there is the need for assuring that only one sheet material is surely inserted into one line of groove. That is, the sheet materials fed in could have, as stated above, a pitch error. Accordingly, the sheet material accumulating unit is required to absorb this pitch error by use of some means and ensure the insertion of the sheet materials into the accumulation impeller 74. Then, according to the prior art, one point at a groove entrance of the accumulation impeller 74 is defined as an insertion point 75, and the control is effected to make the leading edge of the sheet material reach this insertion point 75.

Given next is an explanation of a control method of the accumulating unit in the conventional sheet material inspection apparatus.

A photoelectric sensor 76 is placed in a position across on the conveying path spaced away approximately 1 pitch from the accumulation impeller 74. When sheet material traverses this portion, an output of the sensor changes, thus detecting the leading edge of the sheet material. A rotary encoder 77 is connected to a motor 78 for driving the accumulation impeller 74, whereby a position of the in-rotation blade can be detected.

The sheet material leading edge reaches an optical path of the photoelectric sensor 76 and intercepts a beam of light, and, thus, the sensor output changes. Then, with this output serving as a trigger, a control unit (not shown) reads a value of the encoder 77 and predicts an insertion position of the relevant sheet material into the groove when the accumulation impeller 74 rotates at a standard rotating speed. At this time, if the sheet material deviates from the insertion point 75 of the groove, the control is carried out to correct this deviation. That is, if the leading edge of the sheet material is ahead of the insertion point 75 at the groove entrance, the control unit controls the stepping motor 78 to increase the rotating speed of the accumulation impeller 74. In the reverse case, the control unit controls the stepping motor 78 to decrease the rotating speed of the accumulation impeller 74. In any case, the rotating speed of the accumulation impeller 74 is determined to make the sheet material leading edge coincident with the insertion point. Thus an arithmetic operation is performed each time the sheet material reaches the position of the photoelectric sensor 76. The rotating speed of the accumulation impeller 74 is varied at all times to correct the pitch error between the respective sheet materials. For this reason, the stepping motor 78 always needs a control torque for an acceleration and a deceleration.

The sheet materials taken out are consecutively fed to the accumulation impeller 74. If the sheet material pitch does not undergo an influence by a disturbance or the like during the feed, however, it follows that the sheet material pitch just after being taken out continue to be kept. On the other hand, since a positional relationship between the blades adjacent to each other is fixed, the grooves of the accumulation impeller 74 can not be properly varied corresponding to the sheet material pitch. Accordingly, if the insertion position is shifted with a change in the rotating speed of the accumulation impeller 74 for an i-th sheet material, this shift directly turns out to be a deviation quantity of the (i+1)-th sheet material with respect to the accumulation impeller 74. That is, depending on the way how the sheet material pitch is scattered, if only the insertion position of the just-before sheet material is considered, the deviation quantity with respect to the sheet material subsequent thereto becomes excessive, As a result, a control quantity of the accumulation impeller 74, i.e., a control torque of the motor, becomes excessive, and hence there is a possibility of being incapable of control due to the fact that the motor is out of step. Particularly when speeding up the apparatus, this problem turns out a large obstacle.

In the prior art sheet material inspection apparatus, the insertion position is determined by only the sensor disposed immediately in front of the accumulating unit. Therefore, if the processing speed of the sheet materials is increased, it follows that the control torque needed for the stepping motor for rotating the accumulation impeller increases. This probably results in the incapability of control due to the stepping motor being out of step. Accordingly, the processing speed is conditioned by the control torque of the stepping motor, which hinders the speed-up thereof. For this reason, a high-speed and high-torque motor is needed. However, an unreasonable increment in the motor capacity brings about increases in size, in weight and in cost of the apparatus.

Furthermore, in the sheet material inspection apparatus using the conventional belts, it may happen that the belts come off A prevention of this requires a long time for strict adjustments of a belt tension, a roller inclination, and the like, and the productivity is not therefore favorable. Also, when conveying the sheet materials at high velocity, the motor increases in size, and the structure for attaining the down-sizing and the reduction in weight is hard to realize. The roller conveying system also easily damages the sheet materials and therefore unsuitable for high-speed driving.

SUMMARY OF THE INVENTION

Under such circumstances, it is a primary object of the present invention to provide a sheet material inspection apparatus capable of a high-speed accumulation without increasing a control torque of a motor for driving an accumulation impeller.

It is another object of the present invention to provide a sheet material conveying device in which the sheet material is hard to damage, and that has a simple structure.

According to the present invention, there is provided an apparatus for inspecting sheet materials, comprising:

conveying means for sequentially conveying a plurality of sheet materials;

a rotary body, having a plurality of grooves formed in the periphery thereof enough to permit insertions of the sheet materials, for receiving the sheet materials one by one in the respective grooves while rotating the sheet materials fed from said conveying means;

accumulating means for accumulating the sheet materials inserted into the grooves of said rotary body;

detecting means for detecting a pitch between the sheet materials fed on the conveying unit; and control means for performing control so that the sheet material is inserted from a predetermined position of the groove of said rotary body on the basis of the pitch between the sheet materials that is detected by said detecting means.

In the sheet material inspection apparatus according to this invention, a pitch between the sheet materials to be fed is detected by a plurality of detecting elements provided on a conveying path. Based on this detected pitch between the plurality of sheet materials, a control unit effects the control so that the sheet material is inserted from a predetermined position of a groove of a rotary body (impeller). Even if a pitch deviation is produced when taking out or conveying the subsequent sheet materials, the proper sheet material insertion into the rotary body can be performed by making use of all the data about the sheet material pitches between the individual sheet materials existing on the conveying path ranging from a take-out unit to an accumulating unit.

According to an embodiment of adopting a control of rotating speed of the impeller, while referring to the sheet material pitch data, if a sheet material pitch between a certain sheet material and a sheet material just before it is larger or smaller by a fixed quantity than a standard pitch, a driving system of the rotating impeller is accelerated or decelerated during a passage of the relevant sheet material on the conveying path of the auxiliary feeding unit. Accordingly, the sheet material is inserted in a predetermined insertion range of the accumulation impeller, thus effecting the control. It is therefore possible to reduce an increment quantity of the control torque of the accumulation impeller.

Further, according to an embodiment of adopting an auxiliary conveying means of the sheet material inspection apparatus of this invention, while referring to the sheet material pitch data, if a sheet material pitch between a certain sheet material and a sheet material just before it is larger or smaller by a fixed quantity than a standard pitch, a driving system of the auxiliary conveying means is accelerated or decelerated during a passage of the relevant sheet material on the conveying path of the auxiliary conveying unit. The sheet material pitch between the relevant sheet material and the sheet material just before it is thereby corrected, thus restraining a scatter in terms of the sheet material pitch down to or under a predetermined quantity. The sheet material is inserted in a predetermined insertion range of the accumulation impeller, thus effecting the control. It is therefore possible to further reduce an increment quantity of the control torque of the accumulation impeller.

Moreover, according to the present invention, there is also provided a sheet material conveying device for conveying sheet materials, having a plurality of conveying unit comprising:

a pair of rollers disposed away a predetermined distance from each other;

a driving belt stretched between said pair of rollers and wound on said rollers through a predetermine angle; and a guide member disposed between said pair of rollers so that its upper surface is located more downward by a predetermined spacing than a conveying surface of the driving belt, said conveying surface are opposed to said rollers, whereby the sheet materials are supported between said driving belt and said guide member and being conveyed with the driving of the belt.

The sheet material conveying device of the present invention has guides disposed in face-to-face relationship with belts wound on feeding rollers but provided at a fixed interval on a belt conveying surface between rollers. The feeding rollers are disposed to set the centers of curvatures in the same direction, and, hence, increases a contact force between the sheet material and the belt due to a generation of a centripetal reaction force on the belt by a high-speed feed. The sheet material can be therefore fed by an extremely small amount of driving force. Further, the number of belts can be decreased in terms of its structure as compared with the example of the prior art, and down-sizing of the mechanism is attainable. In addition, the belts are driven with a small resistance and can be readily driven at a high speed. Further, the belts do not come off, and this eliminates the necessity for adjusting a belt tension, and roller inclination, and the like. The time for manufacturing and adjusting the apparatus can be reduced very much. Also, one side of the sheet material is always pressed against the conveying belt, and consequently there is no possibility of damaging the sheet material due to a flip of the sheet material between the rollers. Further, a conveying posture correcting (skew) mechanism for the in-fed sheet material can be easily incorporated by taking the present structure, and a more stable feed detection system can be constructed.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

The present invention will hereinafter be fully discussed by way of embodiments with reference to the accompanying drawings.

Figure 1:
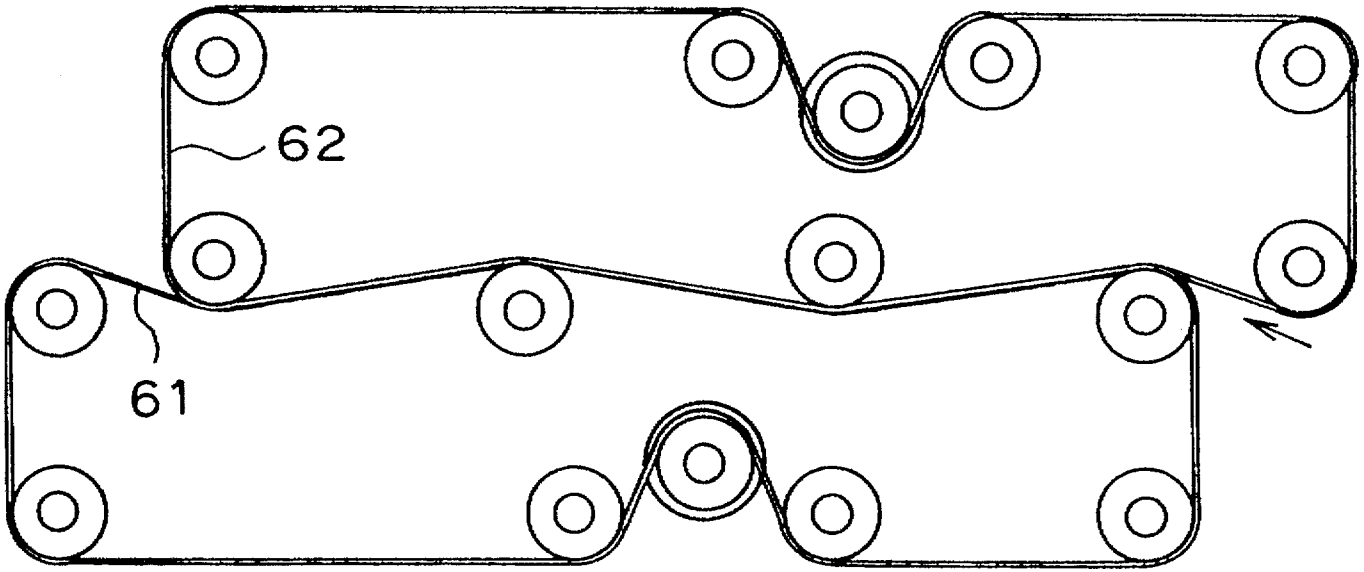
FIG. 1 PRIOR ART
FIG. 1 is a constructive view of a sheet material conveying device employed in a conventional sheet material inspection apparatus.
Figure 2:
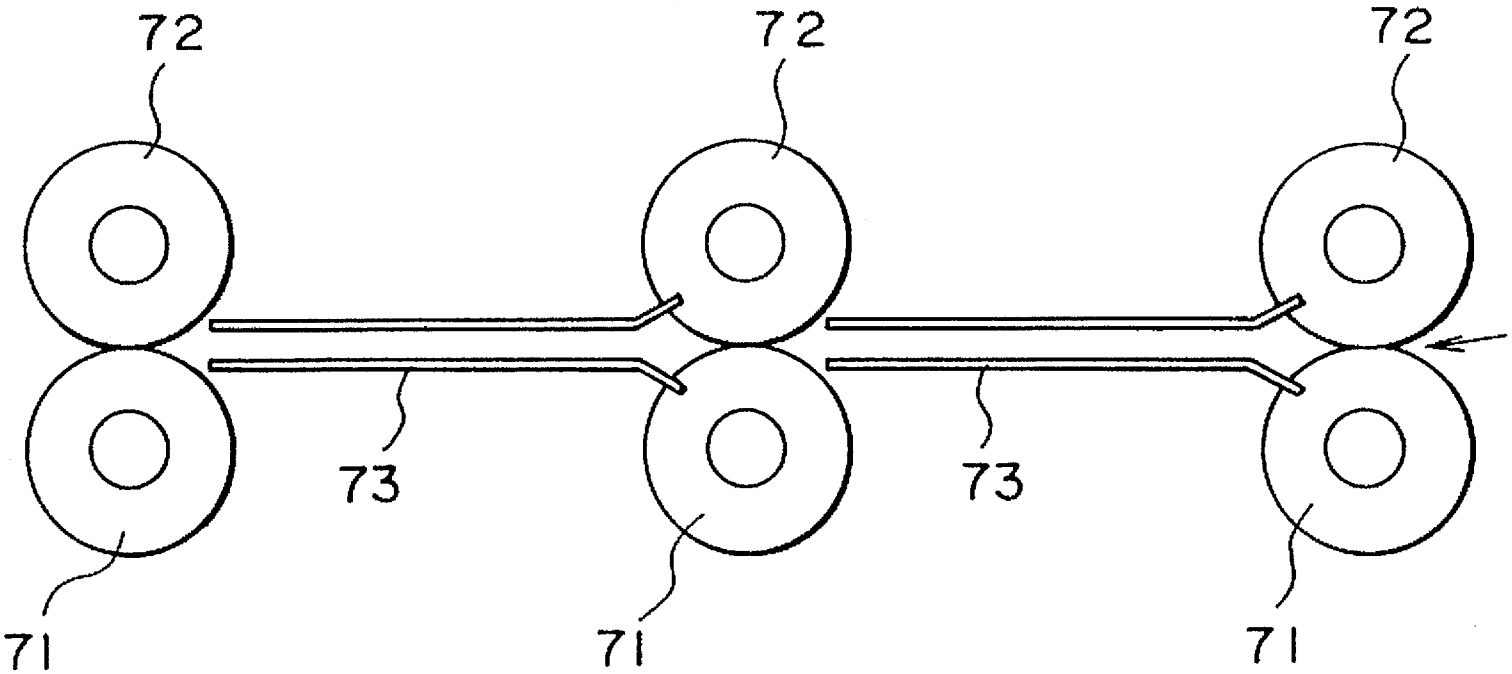
FIG. 2 PRIOR ART
FIG. 2 is a view illustrating a conventional conveying mechanism adopted in the case of conveying the sheet materials at a low velocity.
Figure 3:
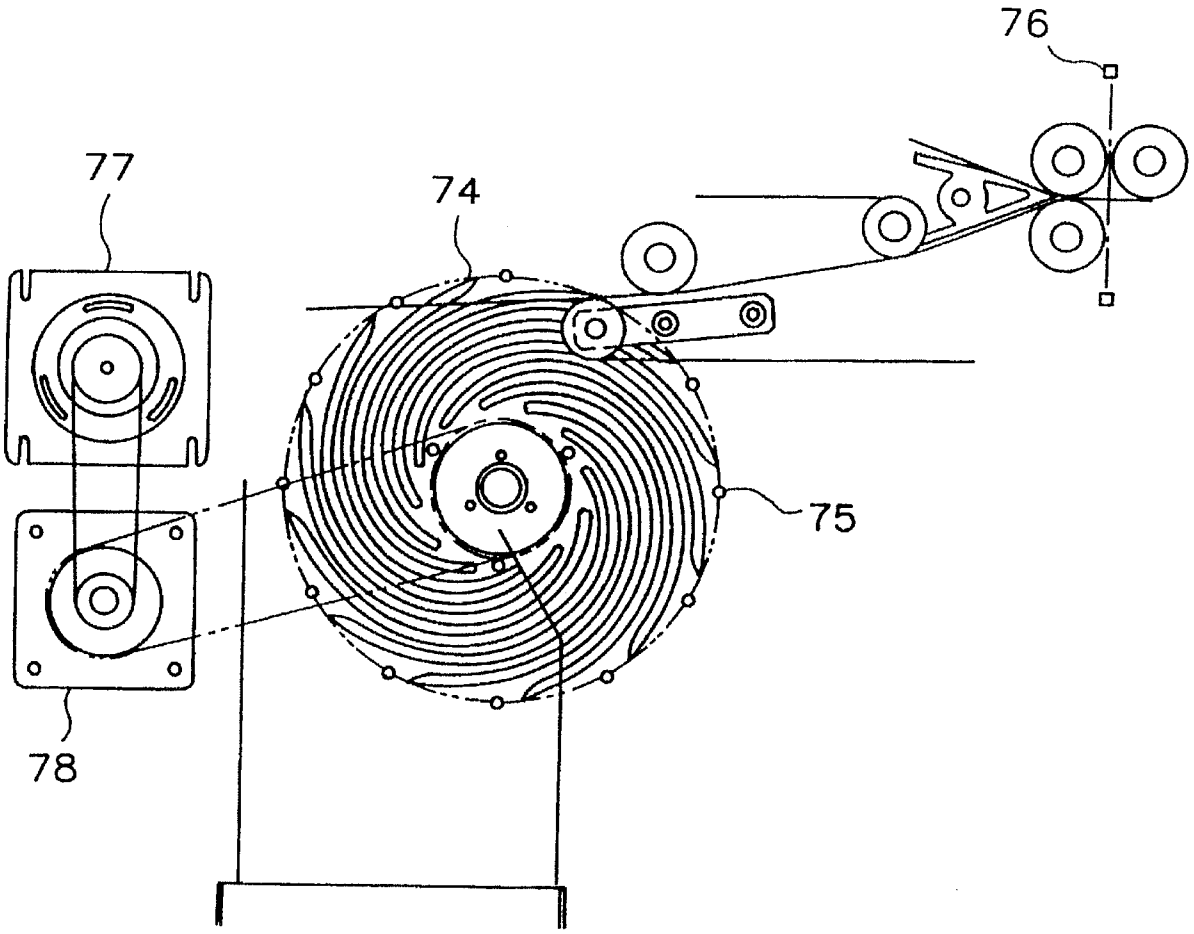
FIG. 3 PRIOR ART
FIG. 3 is a schematic constructive view of a sheet material accumulating unit of the conventional sheet material inspection apparatus.
Figure 4:
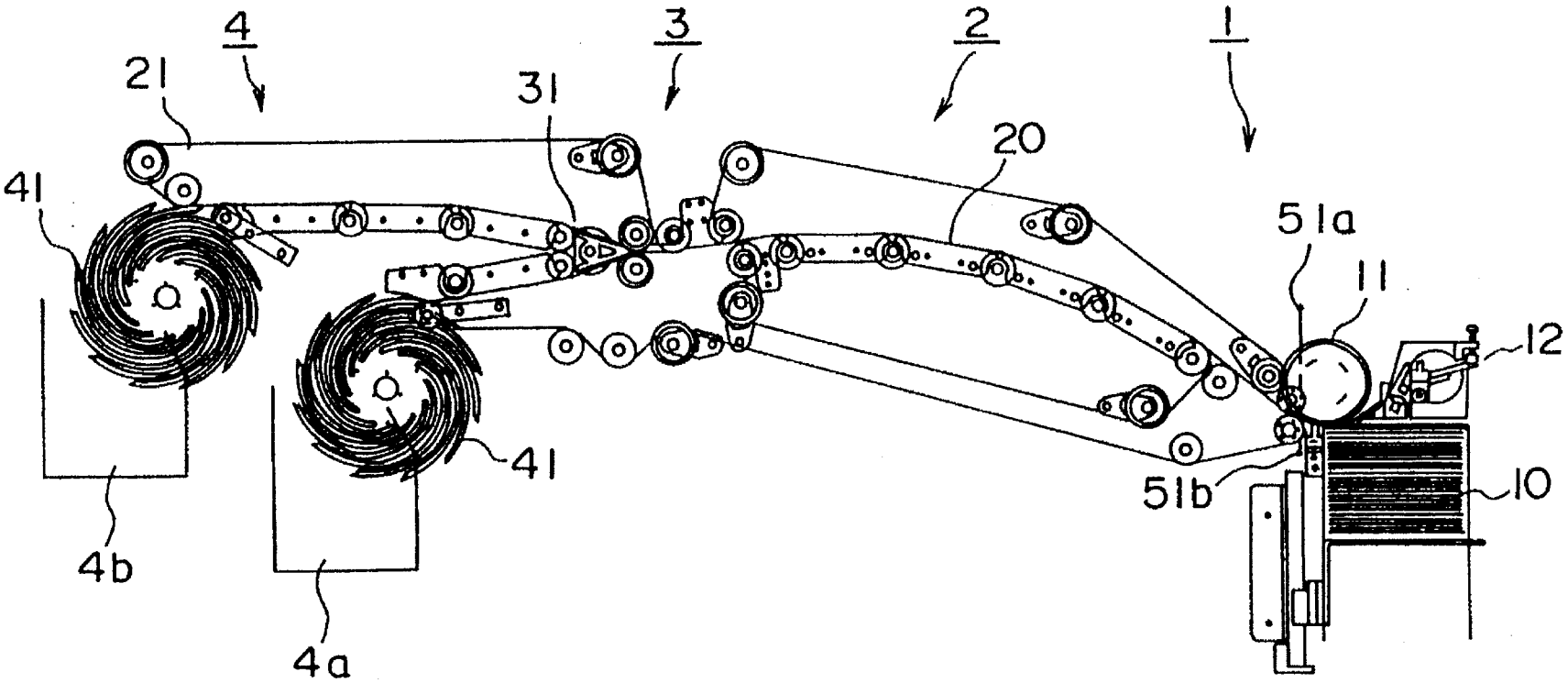
FIG. 4 is a schematic constructive view illustrating the whole construction of a sheet material inspection apparatus according to an embodiment of the present invention.

FIG. 4 is a constructive view illustrating the whole construction of a sheet material inspection apparatus according to an embodiment of the present invention. The sheet material inspection apparatus is constructed of a take-out unit 1, a conveying (detecting) unit 2, a separating unit 3 and an accumulating unit 4 that are disposed in sequence. Sheet materials 10 are fed in a stacked state into this apparatus by a conveying mechanism which is not shown. The sheet materials 10 are separated one by one by a take-out rotor 11 and put into a conveying path constituting a conveying unit 2. A detecting unit (not shown) is disposed above the surface of the sheet material 10 on the conveying path 20. The detecting unit checks each of the sheet materials 10 as to whether the sheet material 10 is normal or damaged and true or false. The accumulating unit 4 is separated into a reusable sheet material accumulating section **4*a* and a disposable sheet material accumulating section 4*b*. As a result of inspecting, the sheet materials 10 are distributed in their conveying directions. This distribution is done through a distribution gate 31 provided on the conveying path 20. An accumulation impeller 41 is provided on each of the accumulating sections 4*a*, 4*b*, thereby receiving but stopping and re-accumulating the sheet materials 10 fed at a high velocity. The reusable sheet materials are stacked in a post-processing unit (not shown) and fed out of the present apparatus. On the other hand, the disposable sheet materials are sent to a disposable processing unit (shredder, not shown). Photoelectric sensors for inspecting a passage of the sheet material 10 are provided in several positions on the conveying path 20. The photoelectric sensors are employed for checking take-out of the sheet material 10, confirming the passage of the sheet material on the conveying path and checking an insertion thereof into the accumulating unit 4 and calculating a pitch of the sheet materials. Herein, the sheet material pitch implies an interval between the leading or trailing edges of the sheet materials fed adjacent to each other. Further, the photoelectric sensor is capable of detecting abnormalities (abnormalities in sheet material length and in sheet material pitch) in the sheet materials 10 on the conveying path 20. Particularly, photoelectric sensor 51***a* and 51*b* disposed just behind the take-up roller 11 serve to calculate the sheet material pitch immediately after taking out the sheet materials 10. The photoelectric sensors 51*a* and 51*b* calculate the sheet material pitch, and, if an abnormal pitch is caused, the system quickly detects this abnormality and takes a proper measure.

Figure 5:
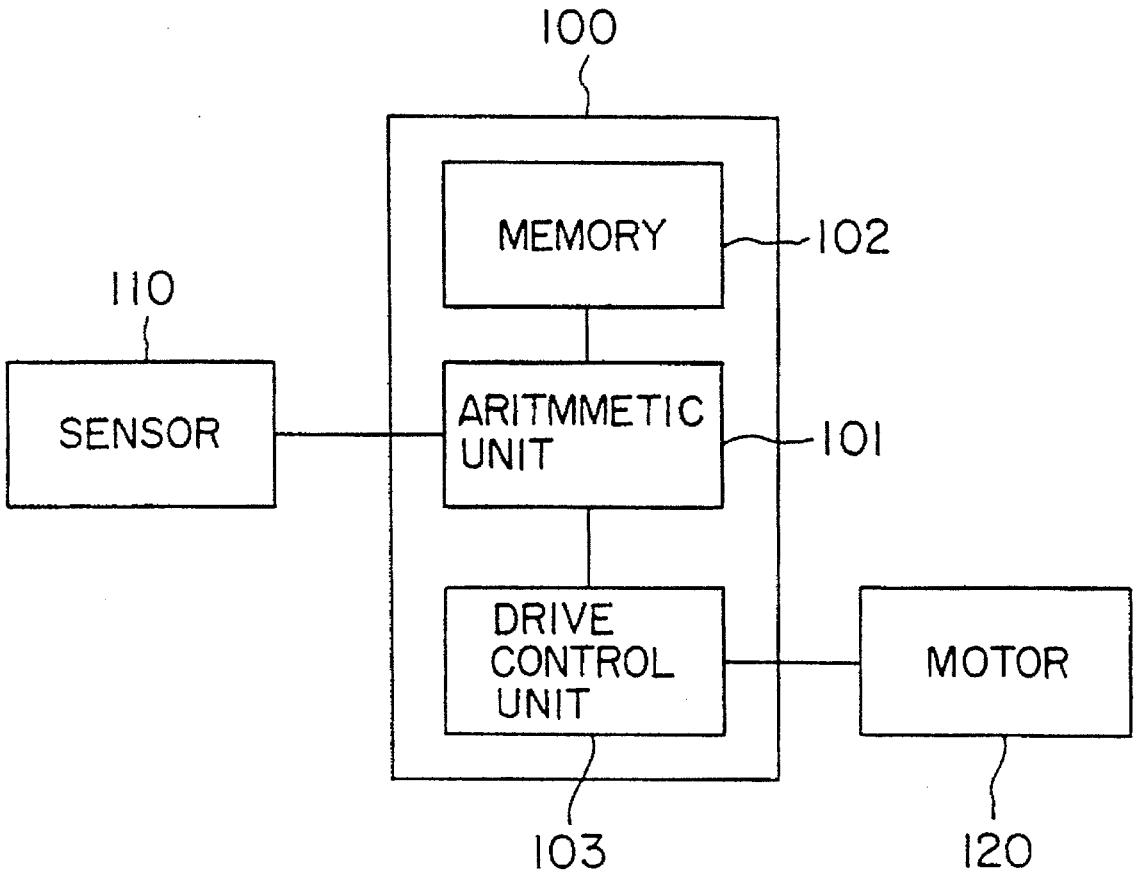
FIG. 5 is a block diagram showing a configuration of a control system of the sheet material inspection apparatus of an embodiment of the present invention.

FIG. 5 is a block diagram illustrating a construction of a control system 100 of the sheet material inspection apparatus according to this invention.

This microcomputer-based control system 100 includes an arithmetic unit 101 for effecting a variety of arithmetic operations, a memory 102 for storing an item of sheet material pitch data which will be mentioned later. The control system also includes a drive control unit 103 for driving a drive motor 120 for a belt or the like on the basis of an arithmetic result given by the arithmetic unit 101. Output signals of a variety of sensors 110 are given to this control system, and, after being rearranged in a data format by the arithmetic unit 101, the arithmetic and storing operations are performed.

Figure 6:
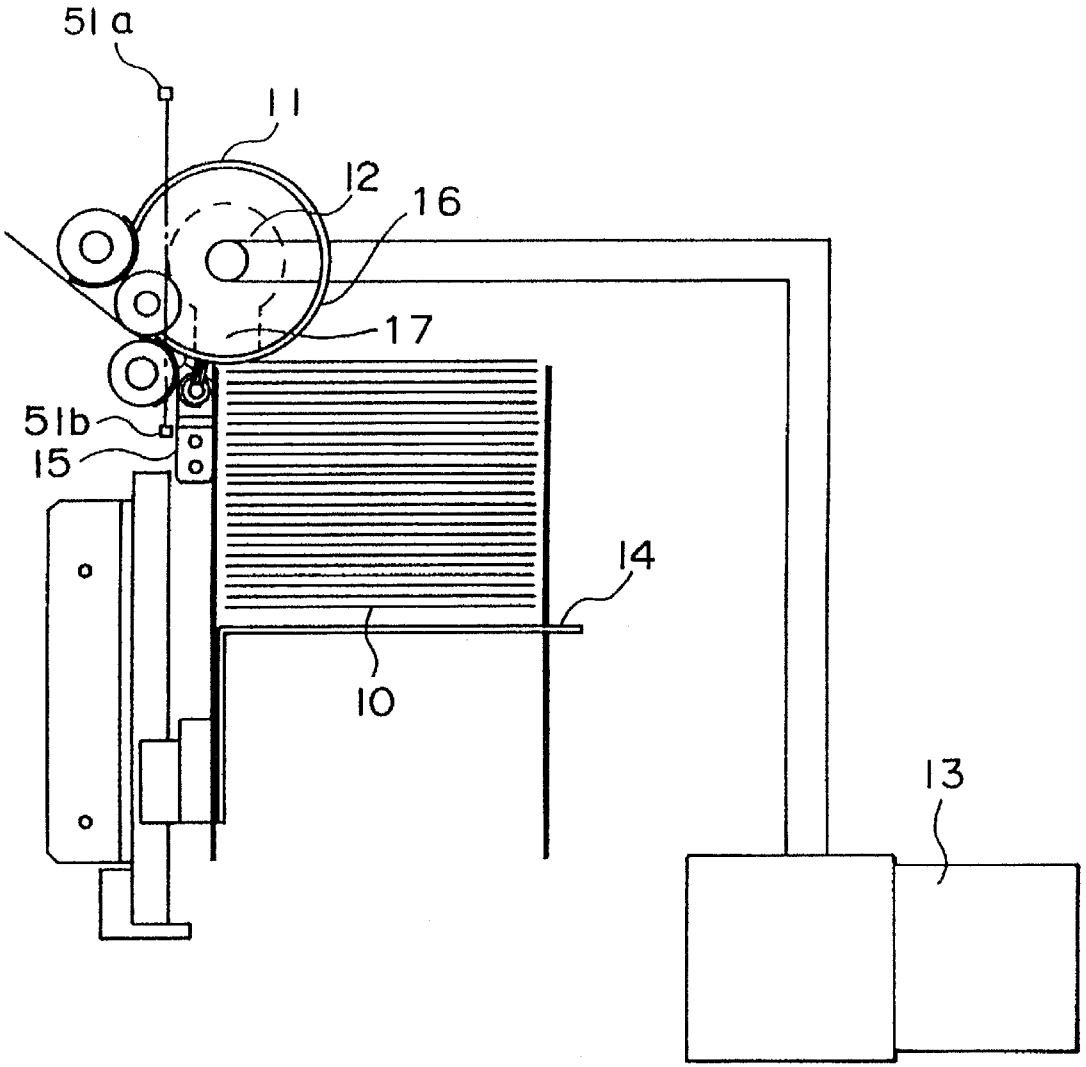
FIG. 6 is a schematic constructive view of a sheet material take-out unit of the sheet material inspection apparatus of an embodiment of the present invention.
Figure 7A:
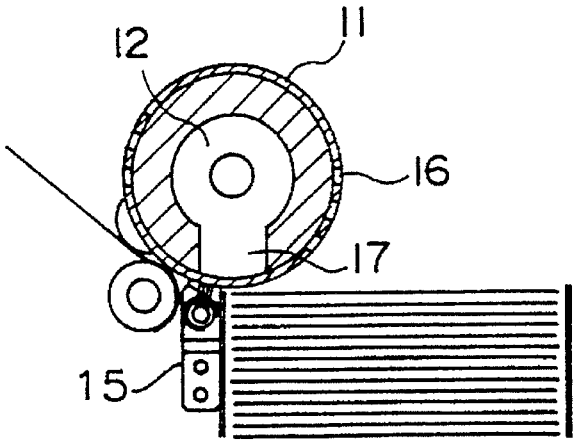
FIGS. 7A–7D are views of assistance in explaining procedures of taking out the sheet materials in the sheet material inspection apparatus of an embodiment of the present invention.
Figure 7B:
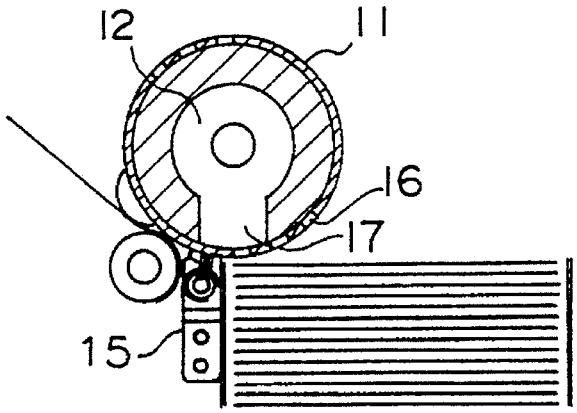
Figure 7C:
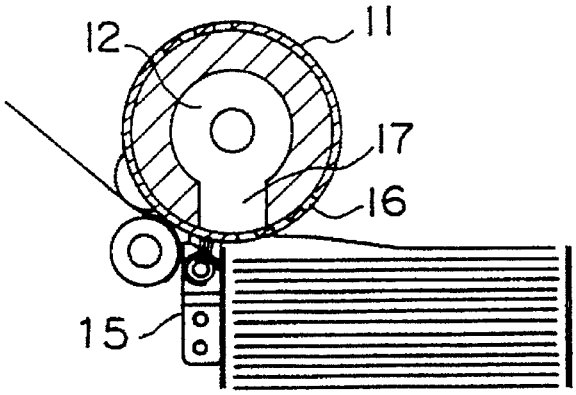
Figure 7D:
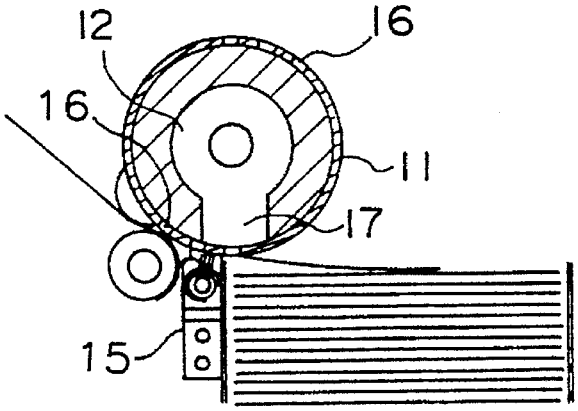

FIG. 6 depicts a construction of the take-out unit. FIG. 6 illustrates how the sheet materials are taken out. The take-out roller 11 is a thin-walled roller including a suction hole 16 (see FIGS. 7A and 7B) cut in the peripheral side surface. The take-out roller 11 is intermittently driven by driving a gear, a cam or a servo motor so as to temporarily stop in such a position that the suction hole 16 comes in to a face-to-face relationship with a sheet material surface within one rotation. A sealed static chamber 12 is accommodated in the interior of the take-out roller 11 but connected to an external vacuum pump 13. An air space within the chamber 12 is kept at a negative pressure with respect to the atmospheric pressure by the vacuum pump 13. If the suction hole 16 of the take-out roller 11 and a position of a notch 17 of the chamber 12 are coincident in the stop position of the take-out roller 11 (FIGS. 7A and 7B), the sheet material 10 on a sheet material feed board 14 is separated from a stack of sheet materials thereunder and sucked by the suction hole 16 when the take-out roller 11 is stopped (FIG. 7C). Then, when the take-out roller 11 starts rotating (FIG. 7D), the sucked sheet material 10 is raised along the side surface of the rotor, and the leading edge thereof is inserted into the conveying path. Hereat, the sheet material is separated unchanged from the side surface of the rotor and then fed. In this case, when the take-out roller 11 starts rotating after sucking the sheet material 10, a stack of sheet materials thereunder may be slightly pulled due to an influence of a frictional force, resulting in a positional deviation. Further, for preventing two sheet materials from being taken out at one time, the underside of the sheet material passing is sucked weakly by a two-sheet material take-out preventive block 15. The second sheet material is herein stopped but not inserted into the conveying unit. At the next take-out timing, this sheet material is sucked by the take-out rotor 11 and then fed.

Figure 9:
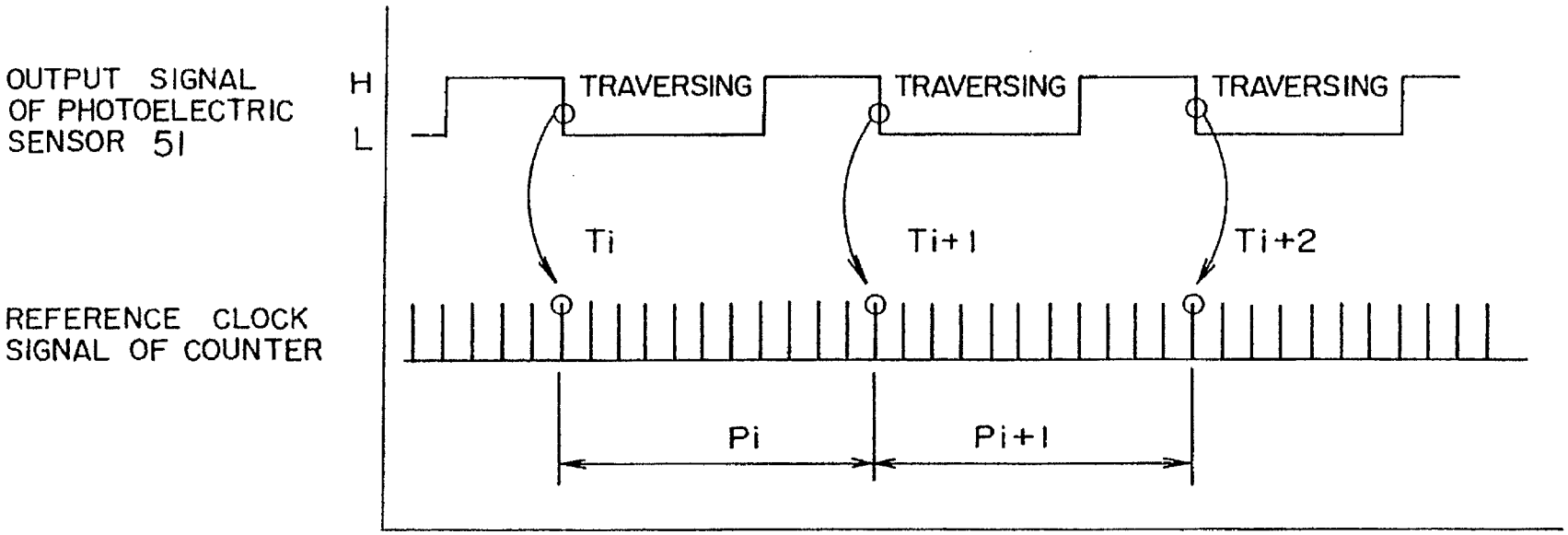
FIG. 9 is a timing chart showing how a sheet material pitch is detected.

FIG. 9 is a timing chart showing how the sheet material pitch is detected. The detection of the sheet material pitch involves the use of a timer, wherein a signal of the photoelectric sensors 51A and 51B shown in FIG. 4 serves as a trigger. When the leading or trailing edge of the sheet material traverses between the photoelectric sensors 51A and 51B, sensor outputs change from an H-level to an L-level. However, this signal serves as the trigger, and a timer signal may be taken in. An i-th sheet material pitch $P_i$ is a time difference between a timer value $T_i$ taken at an i-th time by the detecting unit and a timer value $T_{i+1}$ taken at an (i+1)th time. The sheet material pitches $P_i$ are stored sequentially in the memory.

Figure 10:
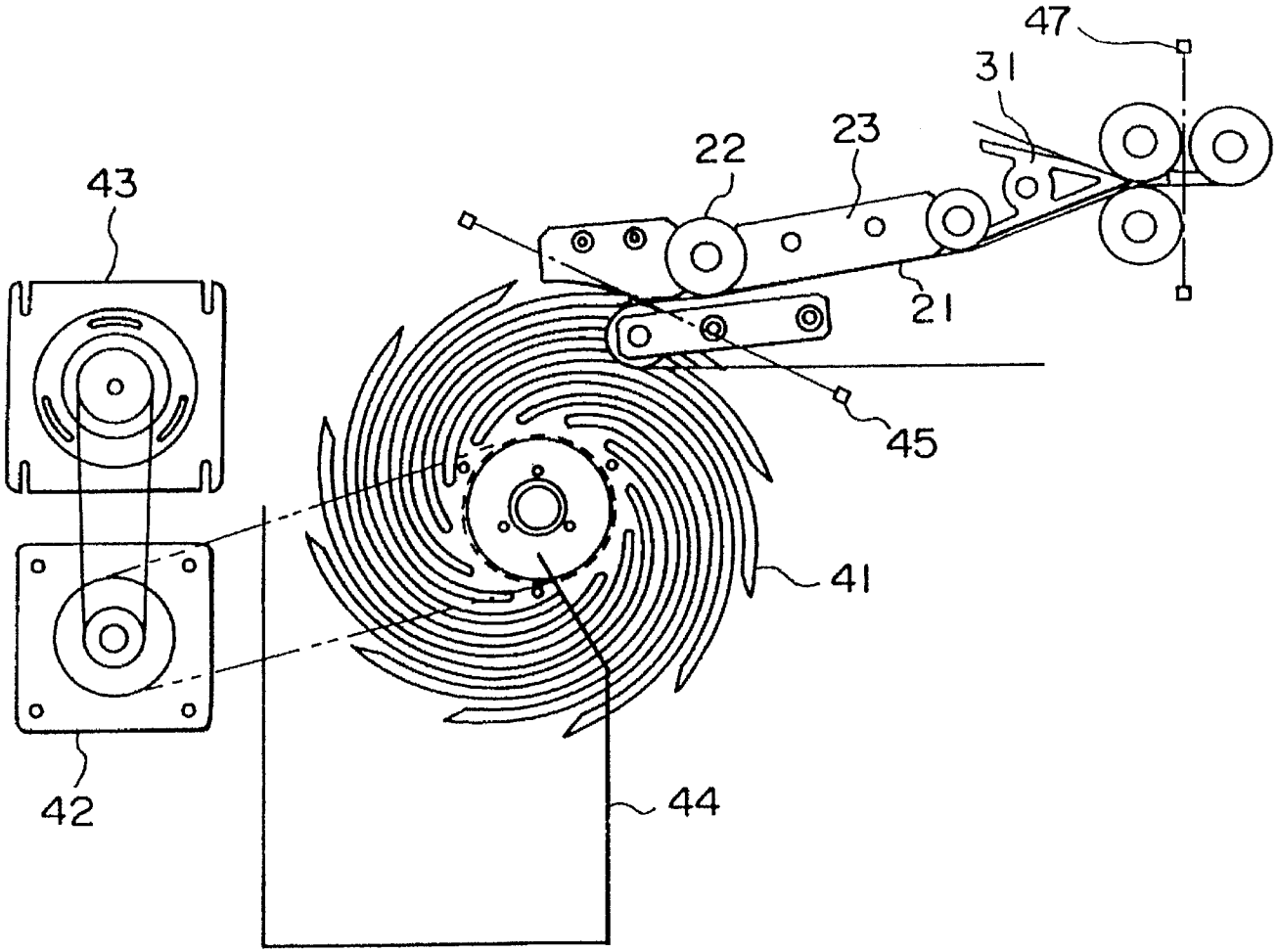
FIG. 10 is a schematic constructive view of a sheet material accumulating unit of the sheet material inspection apparatus of an embodiment of the present invention.

FIG. 10 schematically illustrates a construction of the accumulating unit. The accumulation impeller 41 is rotationally driven by a stepping motor 42. A rotary encoder 43 is belt-connected to the motor shaft and works to monitor a rotational position of the accumulation impeller 41, and an encoder output thereof is supplied to the control unit (not shown).

Figure 11:
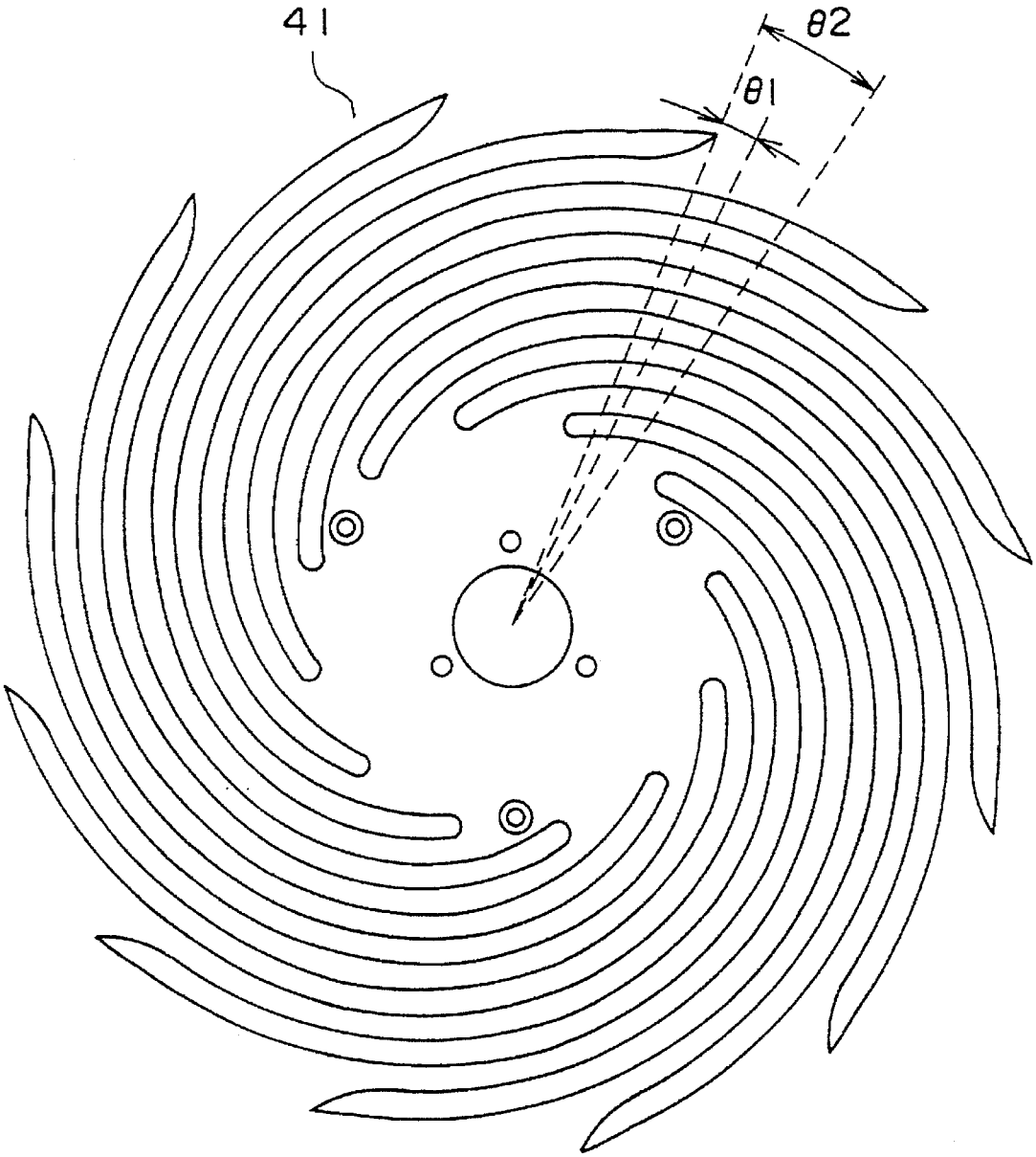
FIG. 11 is a view of assistance in explaining an insertion width in an accumulation impeller of the sheet material inspection apparatus of an embodiment of the present invention.

FIG. 11 shows a construction of the accumulation impeller. This accumulation impeller 41 has twelve lines of spiral grooves formed at equi-angles on a cylinder. An insertion width of the sheet material into this groove falls within a range of central angles θ1 to θ2, wherein the fiducial point is the tip of the blade of the accumulation impeller 41. A set position of this insertion width is determined in consideration of the sheet material length, a sheet material conveying velocity, the number of groves and a rotating speed of the impeller. Namely:

$$L/V<(360/N-\theta 2)/W \tag{1}$$

where L is the sheet material length, V is the sheet material conveying velocity, N is the number of groves, and W is the rotating speed of the accumulation impeller. If this formula is not satisfied, it follows that the sheet material collides with the accumulation impeller 41. Then, the angle which should be selected is θ2 satisfying the formula (1). From the above, θ1, θ2 which determine the insertion width are determined in the following range:

$$0<\theta 1<\theta 2<(360/N-L\cdot W/V) \tag{2}$$

Further, a position given by (θ1+θ2) /2 is set as an original point, and therefore:

$$\theta e=(\theta 2-\theta 1)/2 \tag{3}$$

When this formula (3) is established, ±θe is the insertion width.

Referring back to FIG. 10, a scraping plate 44 is provided on the side surface of the accumulation impeller 41. The sheet materials inserted in the accumulation impeller 41 are neatly arranged by the scraping plate 44, and the leading edges thereof fall down along the scraping plate 44 with rotations of the blades, thus re-accumulating the sheet materials.

An insertion detecting sensor 45 is disposed on the circumference of the accumulation impeller 41. This insertion detecting sensor 45 is constructed of a light emitting element and a light receiving element, and its output changes when the sheet material passes by. The insertion of the sheet material into the accumulation impeller 41 can be recognized by placing the insertion detecting sensor 45 to traverse the conveying path slightly in front of a point at which the sheet material reaches an entrance of the accumulation impeller 41, i.e., an intersection between the conveying path and a line of outer shape of the accumulation impeller 41. An insertion position of the sheet material at a groove entrance of the accumulation impeller 41 can be detected by reading a value of the rotary encoder 43, wherein the output of this insertion detecting sensor 45 serves as a trigger. Items of data about the insertion position and the rotating speed of the accumulation impeller are fed back to the control system. Then, a control characteristic can be also improved by changing a weighing coefficient of an evaluation function which will be stated later.

Figure 12:
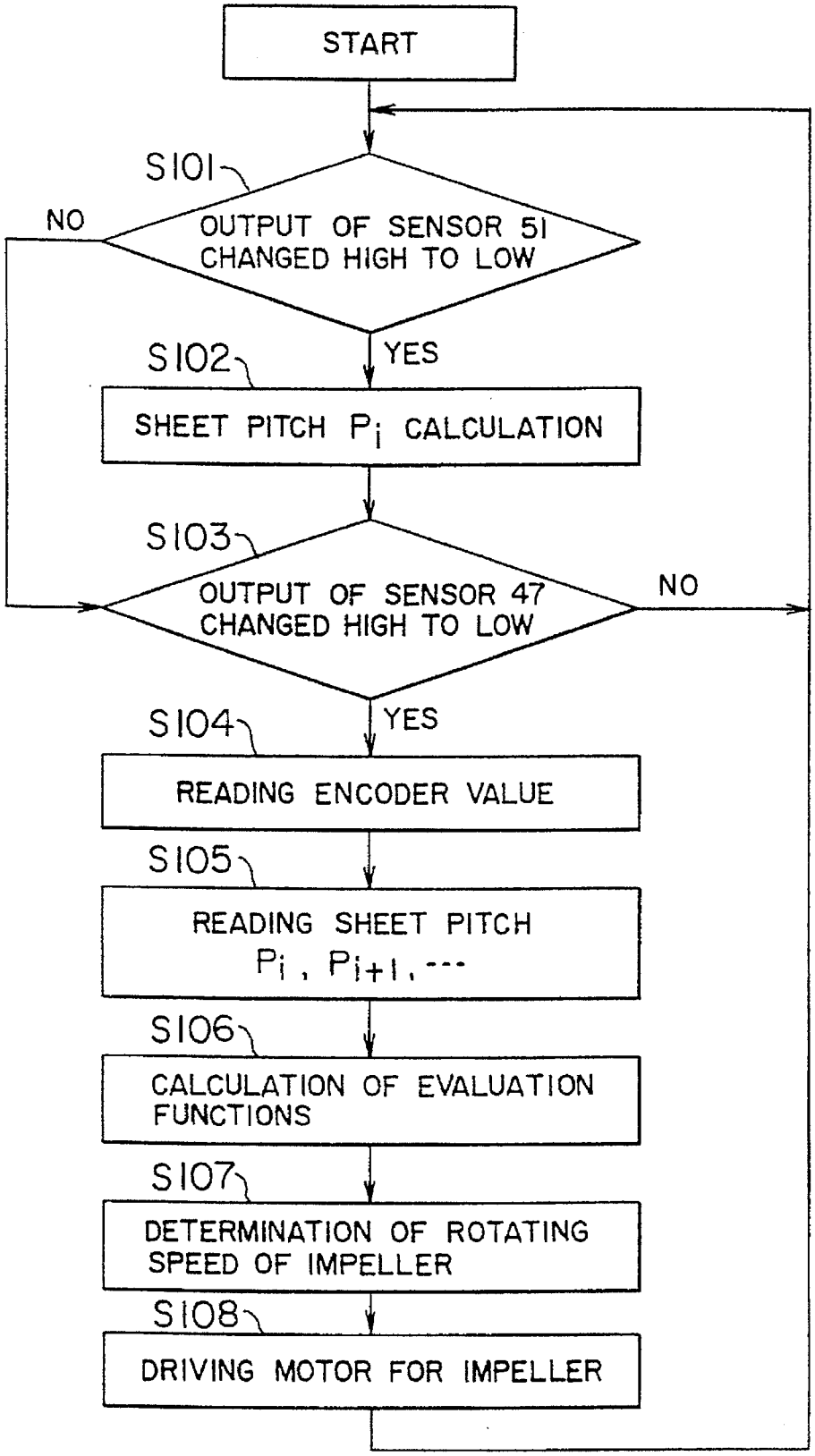
FIG. 12 is a flowchart showing a state of control of an accumulating unit of the sheet material inspection apparatus of an embodiment of the present invention.

FIG. 12 is a flowchart showing a procedure where the control system 100 controls the accumulating unit. The accumulating unit is controlled by a signal of the controller. The rotating speed of the accumulation impeller is determined by use of data about the sheet material pitches of the sheet materials from the one just before being inserted to the one located a plurality of sheet materials behind. This aims at decreasing a peak of control torque of the stepping motor 42 for driving the accumulation impeller 41, wherein an item of control data is the arrangement of the sheet materials from the one just before the insertion to the one located the plurality of sheet materials behind.

Detected as shown in FIG. 12 is that the output of the sensor 51 disposed immediately after the take-out roller 11 changes from HIGH to LOW (step S101). The sheet material pitch Pi is calculated from this fall-to-fall time (step S102). Thus obtained i-th and subsequent sheet material pitches Pi, Pi+1, . . . are stored in the memory.

The sheet materials are fed on the conveying path, and the photoelectric sensor 47 (see FIG. 10) provided on the conveying path disposed away approximately 1 pitch on the basis of the standard sheet material pitch from the accumulation impeller 41 detects a passage of the i-th sheet material (step S103). At this time, the controller causes the encoder 43 to read blade positions of the accumulation impeller 41, thus determining an insertion position of the i-th sheet material (step S104). The target insertion position of this sheet material is a predetermined position within the above-mentioned insertion width. The already-stored sheet material pitch is read (step S105), and an arithmetic operation about the evaluation function which will be stated later is performed (step S106). Thus, the rotating speed of the accumulation impeller 41 is determined to obtain a proper insertion position (step S107). The motor of the impeller is controlled to obtain this rotating speed (step S108). Note that the sheet material pitch data $P_i$ between the sheet material finishing its insertion and the sheet material just behind this sheet material are sequentially erased from the memory 102 in order to save the memory capacity.

Herein, in addition to the assured insertion of the relevant sheet material, the insertion position of the relevant sheet material is determined to reduce a quantity of the pitch deviation of the next sheet material to the greatest possible degree. This makes a large contribution to the reduction in the control torque. Then, in accordance with this embodiment, when determining the insertion position, for example, the evaluation function J expressed by the following equation is obtained, and there is selected such a control quantity as to minimize a value of this evaluation function.

$$J=(\text{Control Quantity})^2+\Sigma(\text{Sheet material Pitch Scatter Quantity Produced In Consequence of Control})^2 \quad (4)$$

Created is a formula in which the parameter in the formula (4) is expressed by the insertion position (insertion angle) into the groove. The symbol $\theta_i$ is the insertion position of the i-th sheet material when the accumulation impeller 41 goes on rotating at the standard speed with respect to the insertion width $\pm\theta e$ determined by the formula (3) given above. If the insertion position is shifted by $\theta c$ due to a fluctuation in the rotating speed, it is required that the following relationship be established:

$$-\theta e<\theta_i+\theta c<\theta e \quad (5)$$

The control quantity $\theta c$ has to fall within the following range:

$$-\theta e-\theta_i<\theta c<\theta e-\theta_i \quad (6)$$

As stated above, each sheet material pitch $P_i$ is stored in the memory immediately after each sheet material is taken out of the take-out unit. Accordingly, the controller for the accumulating unit is thereby capable of knowing the positions of the i-th sheet material and of the subsequent sheet materials and calculating $\theta_{i+1}, \theta_{i+2}, \ldots$ at that time. Then, these items of data are employed for the control, and the evaluation function Ji for controlling the insertion of the i-th sheet material is expressed such as:

$$Ji=(\theta c)^2+\Sigma\left(\sum_{k=1}^{i+n} Ck\ (\theta k+\theta c)\right)^2 \quad (7)$$

The second term of the formula (7) intends to weight an influence on the sheet materials subsequent to the i-th sheet material. In such a range as to satisfy the formula (6), there is selected such $\theta c$ as to minimize Ji in the formula (7). It is thus possible to perform the control assuring the insertion and taking the subsequent sheet materials into consideration. Note that $C_k$ in the formula (6) represents the weighing coefficient of the control of the respective sheet materials, and n is the predicted number of sheet materials used for the control.

Herein, there are a variety of patterns of the sheet material pitch error, and it is difficult to output an optimal control value to any kind of patters with a fixed coefficient at all times. Obtaining the best control result entails, as a matter of course, minimizing the control torque of the stepping motor for driving the accumulation impeller and reducing the scatter in terms of the insertion position of the sheet material. As a measure taken therefor, it can be considered that there is given a fixed coefficient adapted to perform as optimal control as possible with respect to any kind of patterns of the sheet material pitch error; or alternatively, the optimal control is conducted by changing the coefficient per pattern. In the former case, for example, several hundreds to several ten thousands of sheet materials undergo a feed test when adjusted in the factory, and, at the same time, the sheet material insertion position is observed. The coefficient of the above evaluation function is thereby determined to give the least scatter in terms of the insertion position of the sheet material into the accumulation impeller within the insertion width. In the latter case, there are prepared a multiplicity of combinations of the coefficients effective in the variety of patterns of the sheet material pitch error. Pattern matching of the sheet material pitch error is effected when movable, the coefficient of the evaluation function is selected each time, whereby more elaborate control can be attained. In the latter case, an application of a fuzzy rule is effective. Further, there can be also considered such a system as to change the coefficient while working the apparatus by adopting a method employed for learning control of a neural network, AI, and the like, with the aid of a high-speed arithmetic unit.

According to this system, a small amount of adjustments may suffice at the initial stage, and, with the passage of time, quite favorable results can be obtained.

Figure 13:
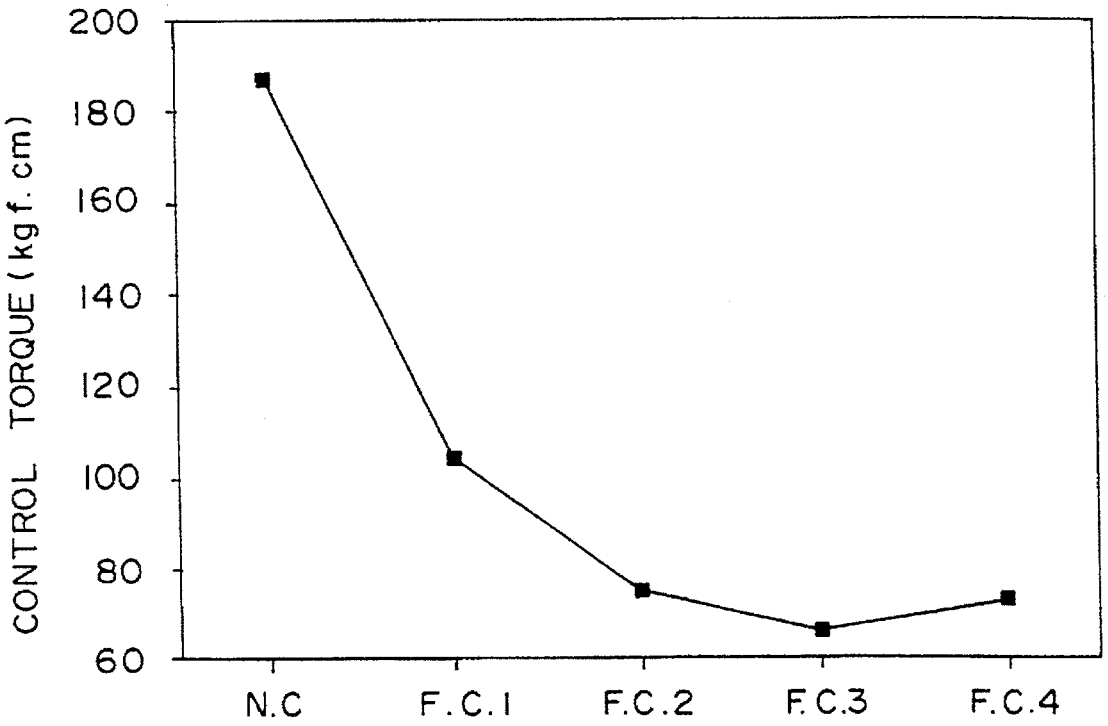
FIG. 13 is a graphic chart showing an effect based on a control system of the sheet material inspection apparatus of another embodiment of the present invention.

FIG. 13 is a graphic chart showing effects based on the accumulation control system of the sheet material inspection apparatus according to this invention. The following are meanings of the symbols given on the axis of the abscissa.

N.C. Control based on only the positional data of the sheet material just before the insertion.

F.C.1 Control based on the data about the pitch from the sheet material on the verge of the insertion to the one located one sheet material behind.

F.C.2 Control based on the data about the pitch from the sheet material on the verge of the insertion to the one located two sheet materials behind.

F.C.3 Control based on the data about the pitch from the sheet material on the verge of the insertion to the sheet material located three sheet materials behind.

F.C.4 Control based on the data about the pitch from the sheet material on the verge of the insertion to the one located four sheet materials behind.

Note that the control conditions when obtaining this result are as below:

| | |
|---|---|
| Processing Speed: | 1200 sheet materials/min |
| Number of Impeller Grooves | 12 (30°) |
| Impeller Rotational Inertia | 16 Kg·cm$^2$ |
| Insertion Width | 7.5° |
| Sheet material Conveying Velocity | 12 m/s |
| Sheet material Pitch Error | ±6ms, caused at random |

As shown above, it can be known that the control torque of the driving motor decreases with an increment in the predicted number of sheet materials employed for the control. In this test, it can be confirmed that a sufficient effect is obtained, wherein the predicted number of sheet materials is 3 to 4.

As discussed above, according to the sheet material inspection apparatus in the present embodiment, when inserting the sheet material into the accumulation impeller, it is possible to reduce the control torque of the motor for driving the accumulation impeller, and, therefore, a higher-speed feed of the sheet material is attainable.

Figure 14:
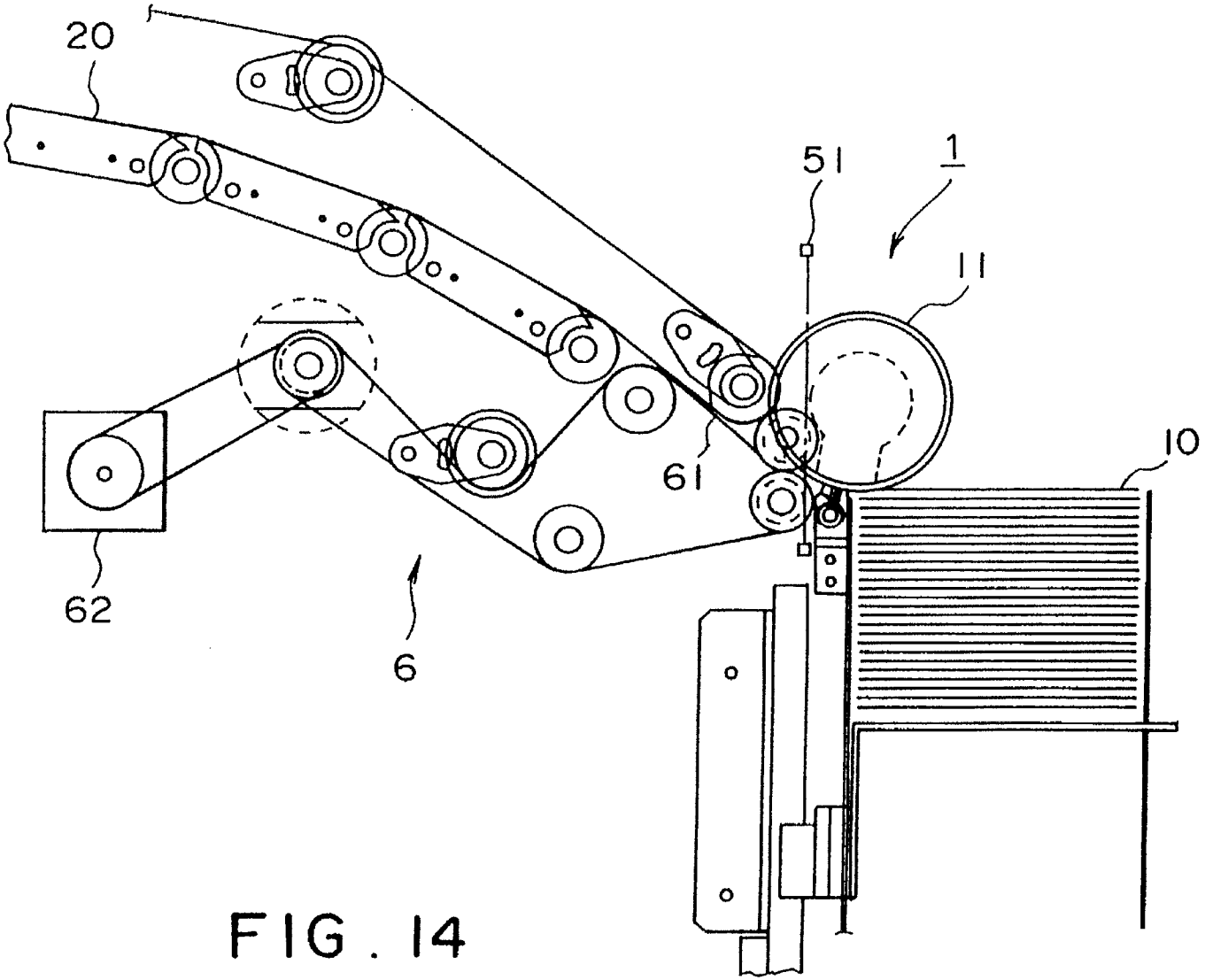
FIG. 14 is a schematic constructive view of an auxiliary conveying unit of the sheet material inspection apparatus of an embodiment of the present invention.

FIG. 14 is a schematic view illustrating a construction of the sheet material inspection apparatus in another embodiment of this invention. Provided in this construction is an auxiliary conveying unit 6 including an auxiliary conveying path 61 disposed just behind the take-out unit 1. This auxiliary conveying path 61 has a length sufficient to admit a passage of substantially one sheet material but is driven independently by an AC servo motor 62 separate from the main conveying path. The controller performs an acceleration and a deceleration of the auxiliary conveying path 61 on the basis of the pitch data of the sheet material immediately after the take-out unit 1. If the pitch error of the sheet material immediately after the take-out unit 1 comes to a magnitude greater than a predetermined error, the sheet material pitch is corrected by the controller. When detecting that the sheet material pitch $P_i$ is larger (or smaller) by a given quantity than the standard pitch, the AC servo motor 62 accelerates (or decelerates) the feed from a point of time when the relevant sheet material reaches the auxiliary conveying path 61, and a pitch error between the i-th sheet material and the sheet material previous thereto is reduced by a predetermined quantity. Supposing that the AC servo motor 62 has a capability to instantaneously decelerate (accelerate) the feed of the sheet material in the auxiliary conveying unit 6 down up to Vmin (Vmax), the pitch correction width Pa is given by the following formula:

$$LD/V-LD/V_{max} \leq Pa \leq LD/V_{min}-LD/V \quad (8)$$

where LD is the length of the auxiliary conveying path 61, and V is the standard sheet material conveying velocity.

For instance, if the sheet material insertion width converted into the sheet material pitch error of the accumulation impeller is ±10% of the standard sheet material pitch, and if the sheet material pitch error generated when taken out is ±30% of the standard sheet material pitch, it follows that the accumulation impeller may absorb +10% with fluctuations in the rotating speed when having such a correction capability as to set Pa to ±10% of the standard sheet material pitch in this auxiliary conveying unit 6. If the auxiliary conveying unit 6 does not exist, however, an error on the order of ±20% has to be absorbed by the fluctuations in the rotating speed. In this way, the control torque of the stepping motor when controlling the accumulation impeller can be reduced by providing the auxiliary conveying unit 6. As a result, the sheet materials can be accumulated at high speed. Further, the sheet materials can be accumulated at a higher speed with a combination of the above-discussed control method of the accumulation impeller according to the above-discussed embodiment of the present invention and the sheet material pitch correction effected by this auxiliary conveying unit.

Next, the conveying system will be explained.

Figure 8A:
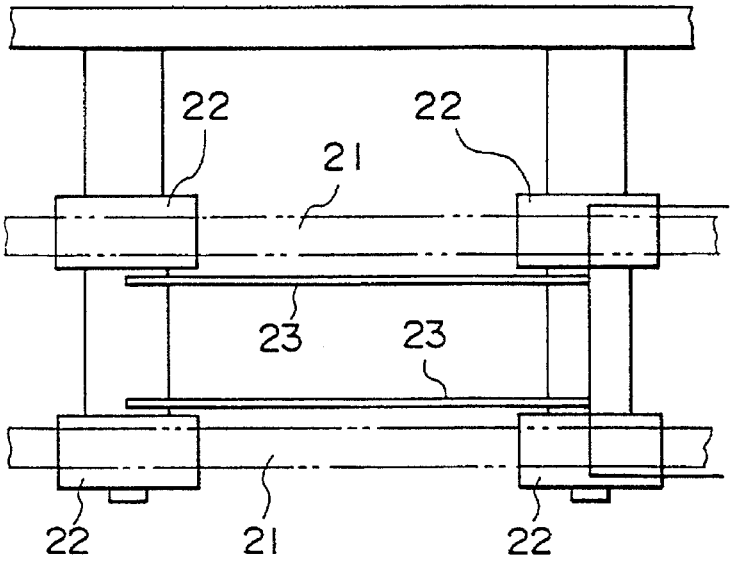
FIGS. 8A–8C are schematic constructive views each showing a sheet material conveying unit of the sheet material inspection apparatus of an embodiment of the present invention.
Figure 8B:
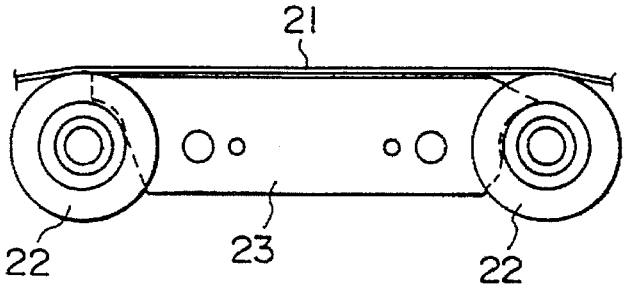
Figure 8C:
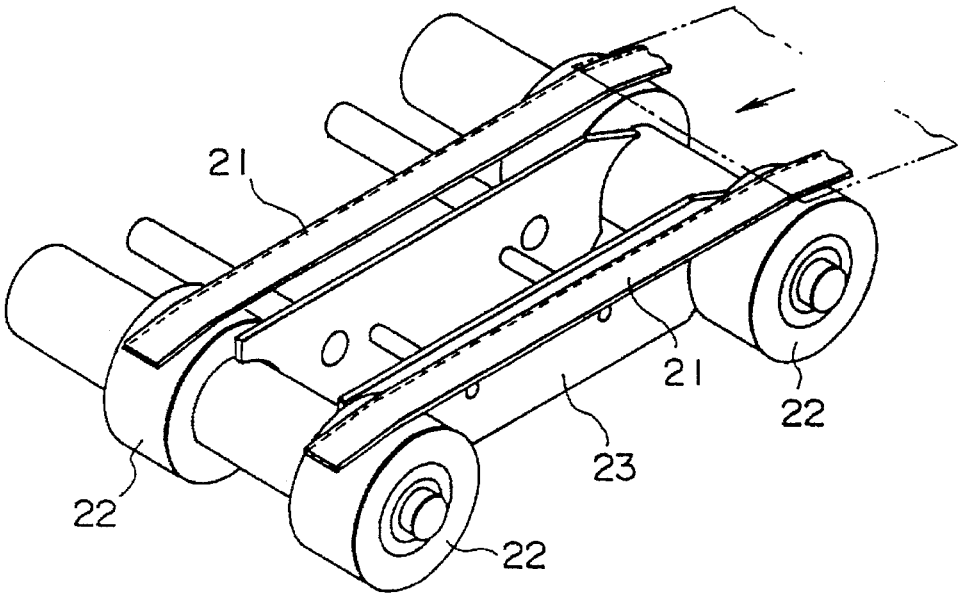

FIGS. 8A–8C schematically illustrate a partial construction of one unit (conveying unit) of the conveying mechanism 20. FIG. 8A is a plan view. FIG. 8B is a front view. FIG. 8C is a perspective view. The conveying mechanism is constructed of belts 21, rollers 22 and guides 23. Two lengths of belts are provided in parallel to the conveying direction. The conveying system provides that the sheet material is held at two portions in the crosswise direction of the feed by the belts 21 and the rollers 22 and thus fed. The belts 21 are wound on drive rollers (not shown) provided in positions off the conveying surface and thus driven at a high velocity. The rollers 22 wound with the belts 21 rotate in idling, whereby the sheet material 10 is fed between the belts 21 and the rollers 22. A spacing between the rollers 22 is set smaller than a length of the sheet material in the conveying direction to surely feed the sheet material 10. Some portion of the sheet material 10 is always held between the belts 21 and the rollers 22, and the driving is conducted with stability. The guides 23 are disposed at a height sufficient to give a clearance on the order of 0.5–3 mm with respect to the belts 21 but laid in a rail-like configuration in the crosswise direction of (perpendicular to) the feed sheet material. The surface material of the guide 23 involves the use of a resinous material and a polymer material (e.g., polytetrafluoroethylene resin) exhibiting a lubricity, thereby making it possible to reduce damage to the sheet material 10 due to a contact therebetween. Further, it is also possible that the metal-worked guide whose surface is coated with a lubricating material, or a member composed of the lubricating material is bonded thereto.

The edges of the guide 23 on both sides thereof are notched in a shape of circular arc along the periphery of the roller shaft from the side to the upper portion of the roller shaft. Also, the front edge of the guide 23, near the upstream roller 22, has a downstream portion in the conveying direction, that is formed with an inclined surface oriented upward of the roller from the guide upper surface. The formation of this inclined surface prevents the sheet material from entering downward of the guide 23. Further, the guides are provided in parallel to the belts and assume a configuration adapted to support the sheet material with a small width, and, therefore, even if a flexure and vibrations of the sheet material in the up-and-down directions are caused during the feed, they do not become obstacles to the feeding. This effectively prevents damage to the sheet material 10 particularly during feeding at high velocity.

The following are advantages of this conveying system. A force of deviation is not generated in the belts, and, hence, it is quite hard for the belts to come off. Further, for this reason, the belt tension is not required to be adjusted. The simple construction thereof requires small numbers of the rollers 22 and of the belts 21, and down-sizing and a reduction in terms of weight of the apparatus are attained. Noises produced are small even during high-speed conveying, and the sheet material 10 is difficult to damage.

Figure 15:
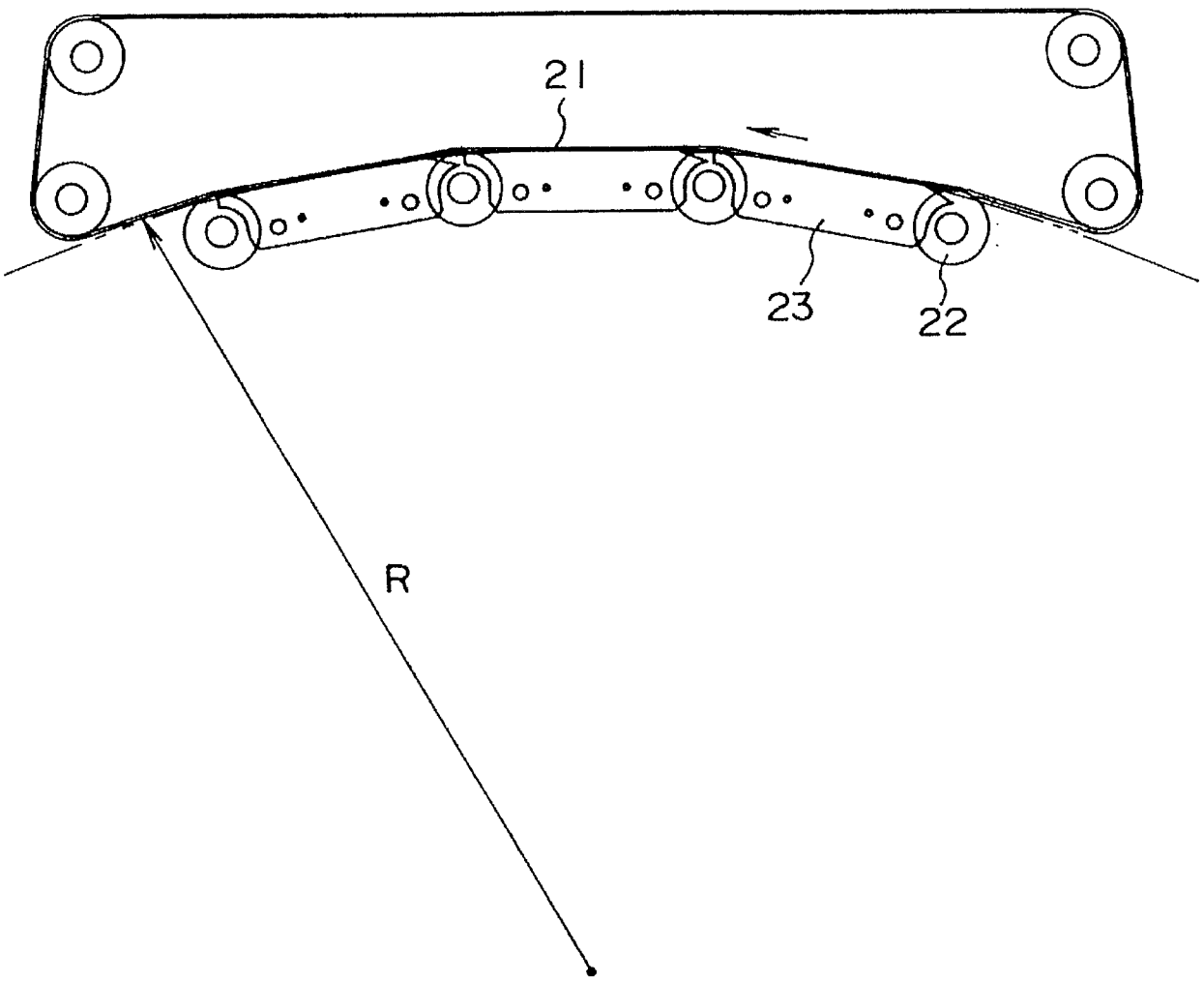
FIG. 15 is a view fully illustrating a configuration of a conveying path shown in FIG. 4.

FIG. 15 is a view illustrating a configuration of the conveying path 20 shown in FIG. 4. The conveying unit shown in FIGS. 8A–8C is constructed in such a manner that a plurality of rollers thereof are connected on the same circular arc. When the belt is driven at a high velocity by such a conveying system, the belt in an arc having a radius R due to its inertia between the rollers. When the sheet material is fed in this state, a centripetal force F in the radial direction acts on the sheet material. Herein, F can be expressed such as:

$$F=mv^2/R \tag{9}$$

where m: the mass of one sheet material, v: the conveying velocity of the sheet material (belt velocity), and R: the curvature of the conveying path.

Also, the conveying force Fp on the sheet material is given by:

$$Fp=\mu F+Fr \tag{10}$$

where

μ: the frictional coefficient between the belt and the sheet material, and

Fr: the conveying force of the roller/belt grasping portion.

In the present conveying system, it can be understood from the formulae (9) and (10) that a contact force of the sheet material on the belt increases with a higher sheet material conveying velocity. For this reason, it follows that one side of the sheet material between the rollers is always pressed against the conveying belt, and it is possible to avoid a rupture caused by a windage loss and a collision with the guide due to a flip of the leading edge of the sheet material. Therefore, this is advantageous especially in conveying at high velocity. Furthermore, the following are other advantages of conveying system. The force of deviation is generated in the belt, and, hence, the belt is hard to come off. Also, for this reason, the adjustment for the belt tension is unnecessary. Small numbers of rollers and of belts may suffice because of the simple construction, and, consequently, the down-sizing and the reduction in weight of the apparatus are attained. The noises produced are low even when fed at high velocity.

Figure 16:
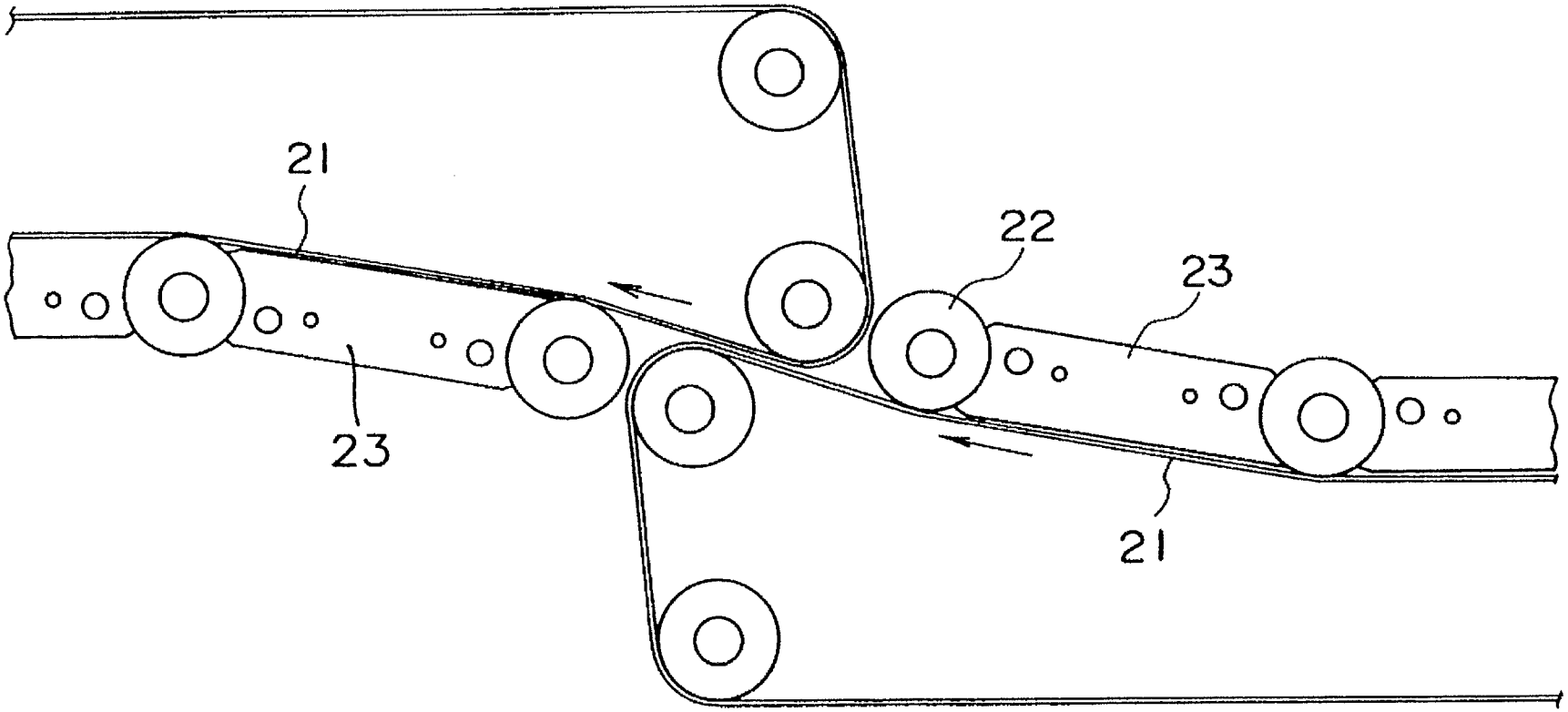
FIG. 16 is a view showing a configuration of a belt-to-belt receiving/conveying unit of the sheet material inspection apparatus of this invention.

FIG. 16 illustrates an example of the configuration of a belt-to-belt receiving/conveying unit in the above-mentioned conveying system in this embodiment. In this example, the leading end of the conveying belt located downstream is in face-to-face relationship with the proximal portion of the belt located upstream. As a result, the guide 23 is disposed above the belt 21 on the downstream side but under the belt 21 on the upstream side.

Figure 17A:
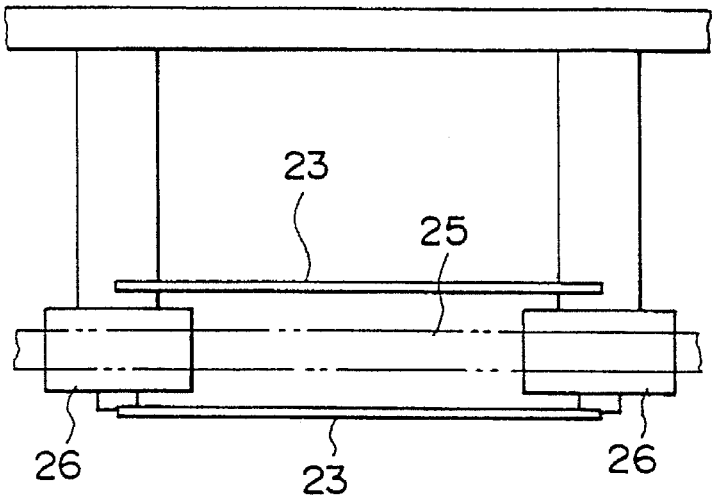
FIGS. 17A–17C are constructive views showing another example of the conveying unit.
Figure 17B:
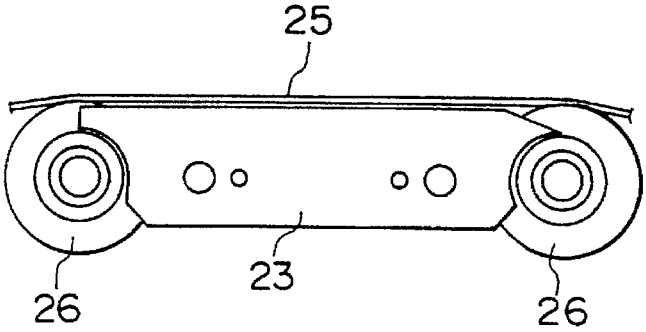
Figure 17C:
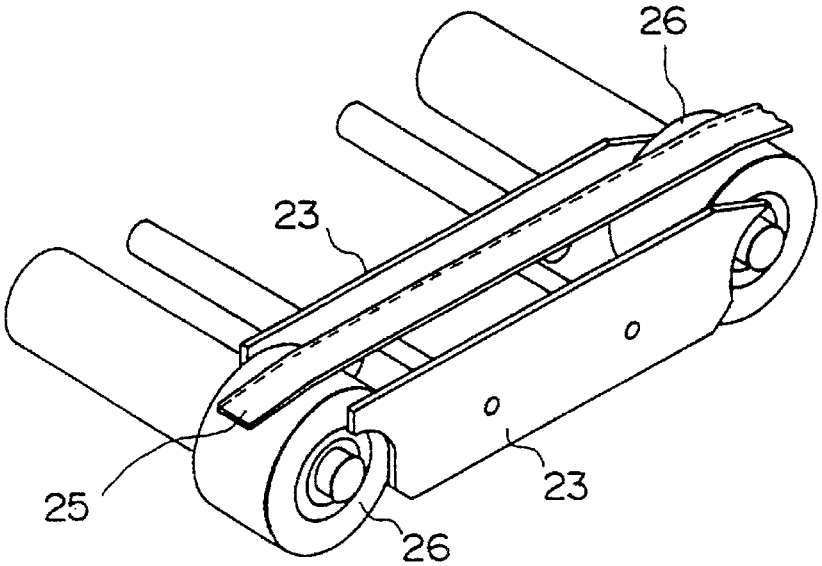

FIGS. 17A–17C show another example of the conveying unit. FIG. 17A is a plan view. FIG. 17B is a front view. FIG. 17C is a perspective view. This conveying system is constructed so that at least one portion of the sheet material in the lengthwise direction is grasped by the belt and the roller, and both edges thereof in the crosswise direction are guided from outside the rollers. This belt is stretched between two rollers 26. Two pieces of guides 23 are provided outward in the crosswise direction of this belt. The shape of this guide is the same as that explained in FIGS. 8A–8C. In this conveying system also, the sheet material can be fed at the high velocity.

Figure 18:
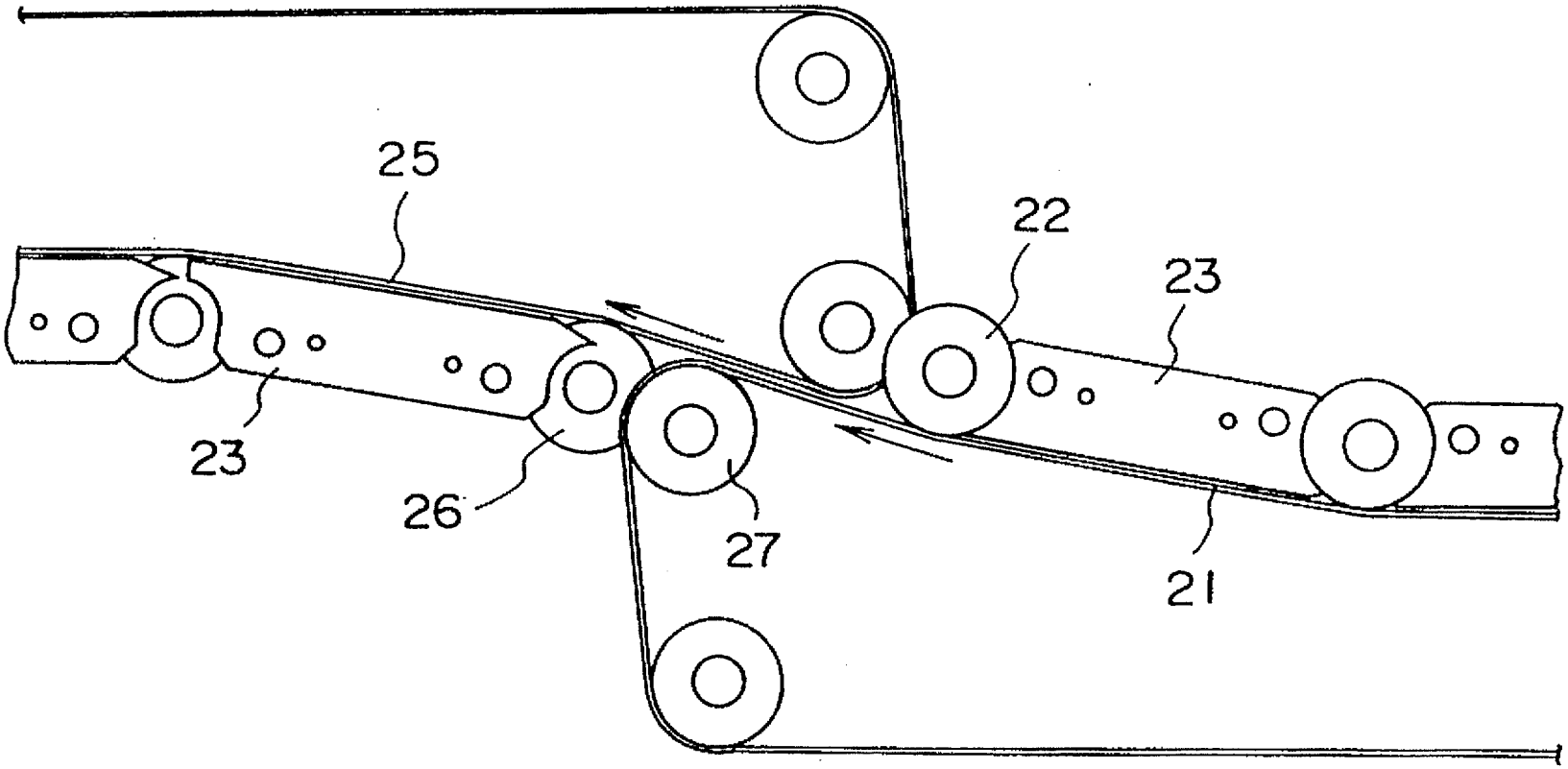
FIG. 18 is a constructive view showing an example of modification of the receiving/conveying unit shown in FIG. 16.

FIG. 18 illustrates a combination of the conveying unit shown in FIGS. 17A–17C and the conveying unit shown in FIGS. 8A–8C. This conveying device takes such a construction that the rollers 26, provided upstream and downstream, of the conveying unit shown in FIGS. 17A–17C are located between two rollers 27 with respect to the downstream-side belt 21. With this construction, a distance between the roller 27 and the roller 26 can be decreased, and it is therefore possible to actualize the conveying system causing fewer of jams.

Figure 19:
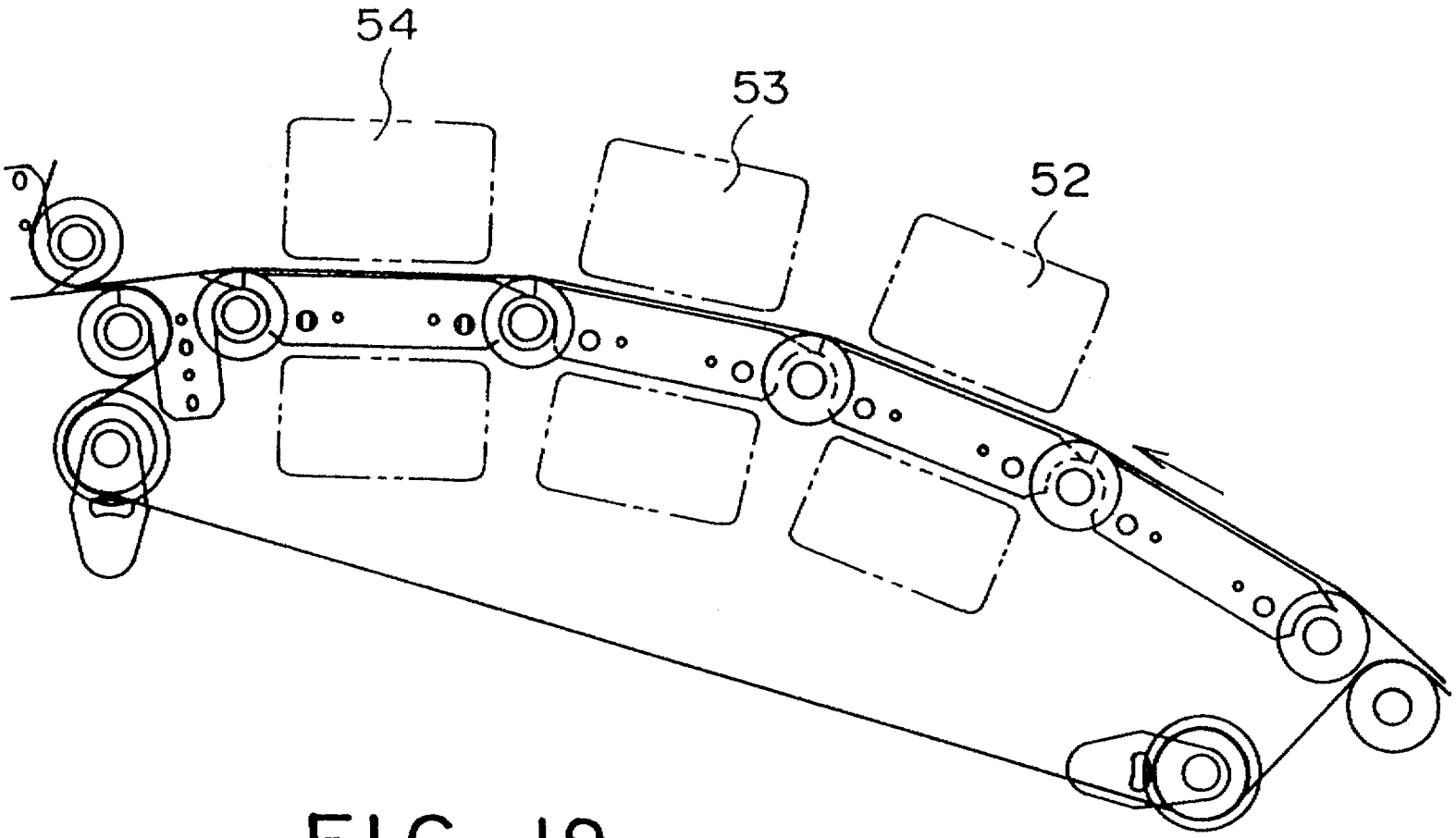
FIG. 19 is a constructive view showing an example where a plurality of detecting units are arranged on a conveying path.

FIG. 19 illustrates an example where detection units 52, 53, 54 for the sheet materials are disposed along the conveying path according to embodiments of the present invention. The rollers are provided concentratedly on one side of the conveying path, and, therefore, a size of the detection system can be considerably freely designed on the side where the rollers do not exist. Hence, there is less constraint in terms of the size when designing the detection device. Further, the distance to the sheet material can be freely set. The same detection device as the conventional one can be basically disposed on the side where the rollers exist. The detection device and the guide are formed into one united body, thereby making it possible to perform the detection in close proximity to the sheet material surface.

Figure 20A:
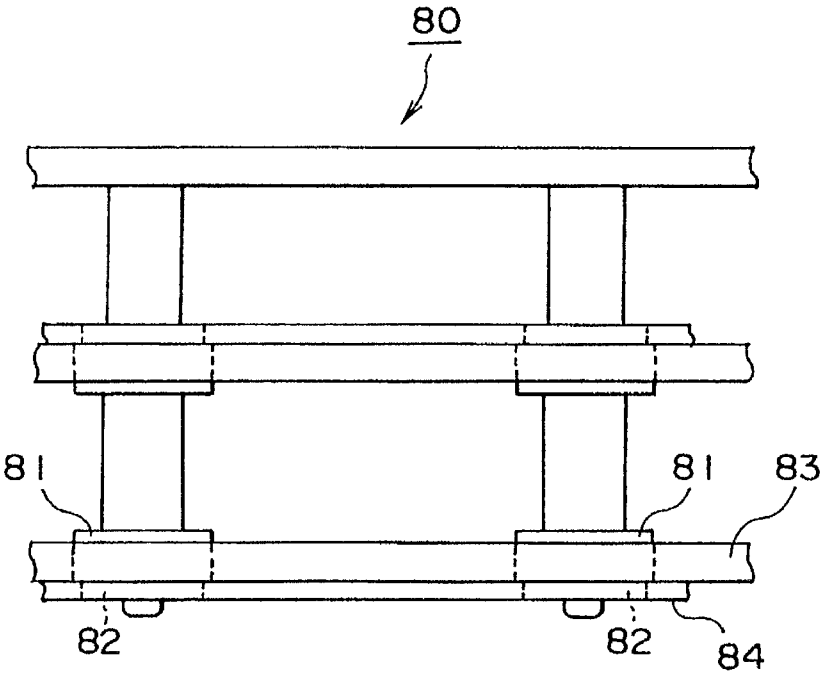
FIGS. 20A–20C are constructive views illustrating a construction of a conveying device in yet another embodiment of the present invention.
Figure 20B:
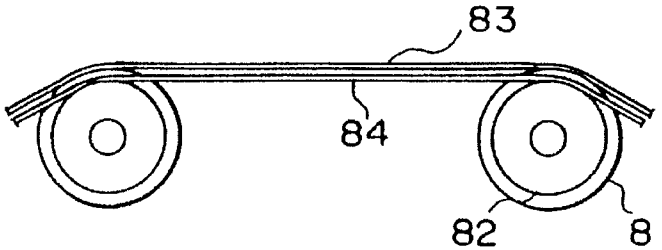
Figure 20C:
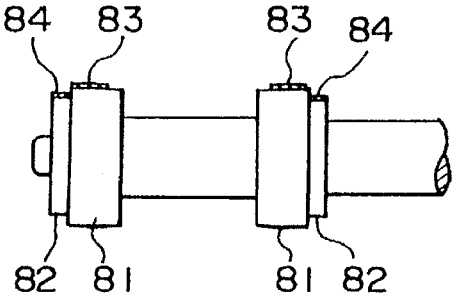

FIGS. 20A–20C illustrate a construction of a conveying device 80 in accordance with yet another embodiment of the present invention. FIG. 20A is a plan view. FIG. 20B is a front view. FIG. 20C is a side view. In this embodiment, the belts are employed in place of the guides of FIGS. 8A–8C. That is, the roller in this embodiment is composed of ordinary rollers 81 and roller members 82 each having a small diameter. A belt 83 is stretched between the rollers 81. A belt 84 is stretched between the rollers 82. A clearance on the order of 0.5–3 mm is provided between the belts 83 and 84. With this arrangement, the belt 84 performs the same function as that of the guide plate explained in FIGS. 8A–8C.

As described above, according to the present invention, it is feasible to freely select a grasping mode and portions of the sheet material and also the guide position.

As discussed above, according to the sheet material inspection apparatus of the present invention, the insertion of the sheet material into the impeller is controlled based on the sheet material-to-sheet material pitch. Hence, it is possible to provide a sheet material inspection apparatus capable of performing the accumulating operation at an extremely high velocity without causing an increase in the control torque of the motor for driving the accumulation impeller in the accumulating unit.

Furthermore, according to the sheet material inspection apparatus of the present invention, the rollers and the belts cooperate to give the conveying force, and, meanwhile, the sheet material is guided by the guide plates. The sheet materials can be thereby stably fed at high velocity using a simple construction.

It is apparent that, in this invention, a wide range of different working modes can be formed based on the invention without deviating from the spirit and scope of the invention. This invention is not restricted by its specific working modes except being limited by the appended claims.

What is claimed is:

1. An apparatus for inspecting sheet materials, the apparatus comprising:

conveying means for sequentially conveying a plurality of sheet materials;

a rotary body, having a plurality of grooves formed in the periphery thereof to permit insertion of the sheet materials, said rotary body receiving the sheet materials one by one in respective grooves while rotating the sheet materials conveyed from said conveying means;

accumulating means for accumulating the sheet materials inserted into the plurality of grooves of said rotary body;

detecting means for detecting a pitch between the sheet materials conveyed on the conveying means; and control means for controlling a rotation status of said rotary body so that each of the sheet materials is inserted into a predetermined position of each of the respective grooves of said rotary body based on the pitch between the sheet materials detected by said detecting means, wherein the control means controls the rotation status of the rotary body to minimize a value obtained by adding a control quantity related to an insertion position of one of the sheet materials to a result of weighing an influence of the one of the sheet materials onto a subsequent sheet material.

2. The apparatus of claim 1, wherein said control means for controlling said rotation status of said rotary body controls a rotating speed of said rotary body based on the pitch detected by said detecting means.

3. The apparatus of claim 1, wherein said conveying means includes an auxiliary conveying means for conveying the sheet materials, driven independently of said conveying means, and said control means includes means for changing a conveying velocity of the sheet materials on said auxiliary conveying means based on the pitch detected by said detecting means.

4. The apparatus of claim 2, wherein said control means includes:

storage means for storing information of the pitch between sheet materials;

arithmetic means for effecting a predetermined arithmetic operation; and mechanism control means for controlling insertion of one of the sheet materials into said rotary body based on an arithmetic result given by said arithmetic means.

5. A sheet material conveying device for conveying sheet materials, the sheet material conveying device having a plurality of conveyors, each of said conveyors comprising:

a pair of rollers disposed a predetermined distance away from each other;

a driving belt stretched between said pair of rollers and wound on said rollers through a predetermined angle;

a guide member disposed between said pair of rollers so that an upper surface of said guide member is located a predetermined constant spacing from a conveying surface of the driving belt; and drive means for driving said driving belt, wherein the conveying surface of the driving belt touches the rollers while the driving belt travels between the rollers, and wherein the sheet materials touch the conveying surface of said driving belt and the upper surface of said guide member while being conveyed by the driving belt.

6. The device of claim 5, wherein an upstream one of said plurality of conveyors has two first rollers on first roller shafts provided upstream and downstream, respectively, and two first guide members disposed inward of said first rollers in a direction substantially orthogonal to a conveying direction, and wherein an adjacent downstream conveyor has two second rollers on second roller shafts, one provided upstream and another provided downstream, and two second guide members disposed outward of said second rollers in the direction substantially orthogonal to the conveying direction.

7. The device of claim 6, wherein said upstream second roller shaft of said adjacent downstream conveyor serves as said downstream first roller shaft of said upstream one of said plurality of conveyors.

8. The device of claim 6, wherein each of said first and second guide members has a curved portion extending from a side portion to an upper portion of each of said first and second roller shafts and is formed with an inclined surface at an upstream front edge.

9. The device of claim 5, wherein said plurality of conveyors are disposed so that a plurality of conveying surfaces defined by a plurality of driving belts form a substantially arc surface having a substantially common center of curvature.

10. An apparatus for inspecting sheet materials, the apparatus comprising:

a conveyor for sequentially conveying a plurality of sheet materials;

a rotary body, having a plurality of grooves formed in the periphery thereof to permit insertions of the sheet materials, the rotary body receiving the sheet materials one by one in respective grooves while rotating the sheet materials conveyed from the conveyor;

an accumulator for accumulating the sheet materials inserted into the plurality of grooves of the rotary body;

a detector for detecting a pitch between the sheet materials conveyed on the conveyer; and a controller for controlling a rotation status of the rotary body so that each of the sheet materials is inserted into a predetermined position of each of the respective grooves of the rotary body based on the pitch between the sheet materials detected by the detector, wherein the controller minimizes a value obtained by adding a control quantity related to an insertion position of one of the sheet materials to a result of weighing an influence of the one of the sheet materials onto a subsequent sheet material.

11. The apparatus of claim 10, wherein said controller controls a rotating speed of said rotary body based on the pitch detected by said detector.

12. The apparatus of claim 11, wherein said controller includes:

a storage for storing information of the pitch between sheet materials;

an arithmetic operator for effecting a predetermined arithmetic operation; and a mechanism controller for controlling insertion of one of the sheet materials into said rotary body based on an arithmetic result given by said arithmetic operator.

13. The apparatus of claim 10, wherein said conveyor includes an auxiliary conveyor for conveying the sheet materials, driven independently of said conveyor, and said controller includes a conveying velocity changer for changing the conveying velocity of the sheet materials on said auxiliary conveyor based on the pitch detected by said detector.

14. A sheet material conveying device for conveying sheet materials, the sheet material conveying device having a plurality of conveyers, each of said conveyors comprising:

a pair of rollers disposed a predetermined distance away from each other;

a driving belt stretched between said pair of rollers and wound around said rollers through a predetermined angle;

a guide member disposed between said pair of rollers so that an upper surface of said guide member is located a predetermined constant spacing from a conveying surface of the driving belt; and a driver for driving said driving belt, wherein the conveying surface of the driving belt touches the rollers while the driving belt travels between the rollers, and wherein the sheet materials touch the conveying surface of said driving belt and the upper surface of said guide member while being conveyed by the driving belt.

15. The device of claim 14, wherein said plurality of conveyors are disposed so that a plurality of conveying surfaces defined by a plurality of driving belts form a substantially arc surface having a substantially common center of curvature.

16. The device of claim 14, wherein an upstream one of said plurality of conveyors has two first rollers on first roller shafts and two first guide members disposed inward of said first rollers in a direction substantially orthogonal to a conveying direction, and wherein an adjacent downstream conveyor has two second rollers on second roller shafts and two second guide members disposed outward of said second rollers in the direction substantially orthogonal to the conveying direction.

17. The device of claim 16, wherein said upstream second roller shaft of said adjacent downstream conveyor serves as said downstream first roller shaft of said upstream one of said plurality of conveyors.

18. The device of claim 16, wherein each of said first and second guide members has a curved portion extending from a side portion to an upper portion of each of said first and second roller shafts and is formed with an inclined surface at an upstream front edge.

* * * * *